US008809428B2

(12) United States Patent
Kim et al.

(10) Patent No.: US 8,809,428 B2
(45) Date of Patent: Aug. 19, 2014

(54) GOLF BALL

(75) Inventors: Hyun J. Kim, Carlsbad, CA (US); Hong G. Jeon, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 669 days.

(21) Appl. No.: 12/645,306

(22) Filed: Dec. 22, 2009

(65) Prior Publication Data

US 2010/0167845 A1 Jul. 1, 2010

Related U.S. Application Data

(60) Provisional application No. 61/140,507, filed on Dec. 23, 2008.

(51) Int. Cl.
*A63B 37/00* (2006.01)
*C08L 77/00* (2006.01)

(52) U.S. Cl.
USPC ..... 524/230; 525/66; 525/92 A; 525/92 B; 525/182; 525/183; 473/373; 473/374; 473/376

(58) Field of Classification Search
None
See application file for complete search history.

(56) References Cited

U.S. PATENT DOCUMENTS

| | | | | |
|---|---|---|---|---|
| 3,264,272 | A | | 8/1966 | Rees et al. |
| 3,804,803 | A | | 4/1974 | Streck et al. |
| 3,974,092 | A | | 8/1976 | Streck et al. |
| 3,974,238 | A | | 8/1976 | Schweiker et al. |
| 4,115,475 | A | | 9/1978 | Foy et al. |
| 4,123,061 | A | | 10/1978 | Dusbiber |
| 4,153,772 | A | | 5/1979 | Schwesig et al. |
| 4,183,876 | A | | 1/1980 | Coran et al. |
| 4,195,015 | A | | 3/1980 | Deleens et al. |
| 4,230,838 | A | | 10/1980 | Foy et al. |
| 4,331,786 | A | | 5/1982 | Foy et al. |
| 4,332,920 | A | | 6/1982 | Foy et al. |
| 4,546,980 | A | | 10/1985 | Gendreau et al. |
| 4,726,590 | A | | 2/1988 | Molitor |
| 4,728,693 | A | | 3/1988 | Dröscher et al. |
| 4,755,552 | A | | 7/1988 | Jadamus et al. |
| 4,792,141 | A | | 12/1988 | Llort |
| 4,838,556 | A | | 6/1989 | Sullivan |
| 4,840,993 | A | | 6/1989 | Bartz |
| 4,844,471 | A | | 7/1989 | Terence et al. |
| 4,852,884 | A | | 8/1989 | Sullivan |
| 4,894,411 | A | | 1/1990 | Okada et al. |
| 4,950,826 | A | | 8/1990 | Zerpner et al. |
| 4,955,966 | A | | 9/1990 | Yuki |
| 5,334,673 | A | | 8/1994 | Wu |
| 5,385,776 | A | | 1/1995 | Maxfield et al. |
| 5,436,295 | A | | 7/1995 | Nishikawa et al. |
| 5,460,367 | A | | 10/1995 | Horiuchi |
| 5,820,486 | A | * | 10/1998 | Tanaka et al. ..... 473/374 |
| 5,948,862 | A | | 9/1999 | Sano et al. |
| 5,959,059 | A | | 9/1999 | Vedula et al. |
| 5,962,553 | A | | 10/1999 | Ellsworth |
| 6,012,991 | A | | 1/2000 | Kim et al. |
| 6,100,321 | A | | 8/2000 | Chen |
| 6,180,722 | B1 | | 1/2001 | Dalton et al. |
| 6,193,617 | B1 | | 2/2001 | Mertens |
| 6,329,458 | B1 | | 12/2001 | Takesu et al. |
| 6,426,387 | B1 | | 7/2002 | Kim |
| 6,476,176 | B1 | | 11/2002 | Wu |
| 6,485,378 | B1 | | 11/2002 | Boehm |
| 6,508,724 | B2 | | 1/2003 | Dalton |
| 6,562,906 | B2 | | 5/2003 | Chen |
| 6,569,037 | B2 | | 5/2003 | Ichikawa et al. |
| 6,582,326 | B2 | | 6/2003 | Wu et al. |
| 6,616,552 | B2 | | 9/2003 | Takesue et al. |
| 6,635,716 | B2 | | 10/2003 | Voorheis et al. |
| 6,692,379 | B2 | | 2/2004 | Morgan et al. |
| 6,762,244 | B2 | | 7/2004 | Rajogopalan et al. |
| 6,770,360 | B2 | | 8/2004 | Mientus et al. |
| 6,776,942 | B2 | | 8/2004 | Kim |
| 6,780,933 | B2 | * | 8/2004 | Rajagopalan et al. ..... 525/92 A |
| 6,794,447 | B1 | | 9/2004 | Kim et al. |
| 6,812,276 | B2 | | 11/2004 | Yeager |
| 6,835,146 | B2 | | 12/2004 | Jordan et al. |
| 6,861,474 | B2 | | 3/2005 | Kim |
| 6,878,075 | B2 | | 4/2005 | Kim |
| 6,905,423 | B2 | | 6/2005 | Morgan et al. |
| 6,930,150 | B2 | | 8/2005 | Kim |

(Continued)

FOREIGN PATENT DOCUMENTS

| | | | |
|---|---|---|---|
| JP | 60249980 | | 12/1985 |
| JP | 63221157 | | 9/1988 |
| JP | 2002348467 | * | 12/2004 |
| WO | WO 99/08756 | * | 2/1999 |

OTHER PUBLICATIONS http://www.chemsoc.org/chembytes/ezine/2002/birkett_july02.htm (accessed on Nov. 1, 2006).
http://bppetrochemicals.com (accessed on Nov. 1, 2006) (http://bp.com/modularhome.do?_categoryId=6110).
http://www.nml.csir.co.za/news/20020711/index1.htm. (accessed on May 29, 2007).
http://www3.interscience.wiley.com/cgi-bin/abstract/70000886/ABSTRACT (accessed on May 29, 2007).
Akrochem Proaid AC 18E product literature; no date.
Schuler et al., "Fate of Erucamide in Polyolefin Films at Elevated Temperature," *Polym. Eng. Sci.* 44:2247-2253 (2004).
Thain, *Science and Golf IV*; pp. 319-327; Jul. 2002.
English translation of Notice of Reasons for Rejection from the Japanese Patent Office dated Feb. 20, 2008 in Japanese Patent Application No. 2006-014614.
English translation of Notice of Reasons for Rejection from the Japanese Patent Office dated Oct. 22, 2008 in Japanese Patent Application No. 2006-014614.

*Primary Examiner* — David Buttner
(74) *Attorney, Agent, or Firm* — Klarquist Sparkman LLP

(57) ABSTRACT

The present disclosure relates to golf balls having components including intermediate layers and outer cover layers prepared from blends of polyamides mixed with one or more functional polymer modifiers. The functional polymer modifier incorporates a copolymer or a terpolymer having a glycidyl group, hydroxyl group, maleic anhydride group or carboxylic group, or a mixture of these. When used in golf ball covers or mantles, these materials exhibit improved impact durability when compared to analogous balls but having ionomeric- or polyurethane-based layers of similar hardness.

13 Claims, 2 Drawing Sheets

(56) References Cited

U.S. PATENT DOCUMENTS

| | | | | |
|---|---|---|---|---|
| 6,960,629 | B2 | 11/2005 | Voorheis et al. | |
| 7,041,769 | B2 | 5/2006 | Wu et al. | |
| 7,332,533 | B2 | 2/2008 | Kim et al. | |
| 7,528,196 | B2 | 5/2009 | Kim et al. | |
| 2001/0005699 | A1 | 6/2001 | Morgan et al. | |
| 2002/0040111 | A1 | 4/2002 | Rajagopalan | |
| 2003/0069087 | A1 | 4/2003 | Ichikawa et al. | |
| 2003/0078348 | A1* | 4/2003 | Rajagopalan et al. | 525/425 |
| 2003/0119989 | A1 | 6/2003 | Ladd et al. | |
| 2003/0158312 | A1 | 8/2003 | Chen | |
| 2003/0224871 | A1 | 12/2003 | Kim et al. | |
| 2004/0019138 | A1 | 1/2004 | Voorheis et al. | |
| 2004/0044136 | A1 | 3/2004 | Kim | |
| 2004/0082408 | A1 | 4/2004 | Sullivan et al. | |
| 2004/0092336 | A1 | 5/2004 | Kim et al. | |
| 2004/0209708 | A1 | 10/2004 | Bulpett et al. | |
| 2004/0236030 | A1 | 11/2004 | Kim et al. | |
| 2004/0248669 | A1 | 12/2004 | Kim et al. | |
| 2005/0059756 | A1 | 3/2005 | Kim et al. | |
| 2005/0075196 | A1 | 4/2005 | Shimizu et al. | |
| 2006/0014898 | A1 | 1/2006 | Kim | |
| 2006/0128858 | A1* | 6/2006 | Sullivan et al. | 524/322 |
| 2007/0100085 | A1* | 5/2007 | Kim et al. | 525/374 |
| 2008/0090678 | A1 | 4/2008 | Kim et al. | |

* cited by examiner

GOLF BALL

CROSS REFERENCE TO RELATED APPLICATION

This application claims the benefit of U.S. Provisional Application No. 61/140,507, filed Dec. 23, 2008, which is incorporated herein by reference in its entirety.

BACKGROUND OF INVENTION

The application of synthetic polymer chemistry to the field of sports equipment has revolutionized the performance of athletes in many sports. One sport in which this is particularly true is golf, especially as relates to advances in golf ball performance and ease of manufacture. For instance, the earliest golf balls consisted of a leather cover filled with wet feathers. These "feathery" golf balls were subsequently replaced with a single piece golf ball made from "gutta percha," a naturally occurring rubber-like material. In the early 1900's, the wound rubber ball was introduced, consisting of a solid rubber core around which rubber thread was tightly wound with a gutta percha cover.

More modern golf balls can be classified as one-piece, two-piece, and three-piece. One-piece balls are molded from a homogeneous mass of material upon which is molded a dimple pattern. One-piece balls are inexpensive and very durable, but do not provide great distance because of relatively high spin and low velocity. Two-piece balls are made by molding a cover around a solid rubber core. These are the most popular types of balls in use today. In attempts to further modify the ball performance, especially in terms of the distance such balls travel, and the feel transmitted to the golfer through the club on striking the ball, the basic two piece ball construction has been further modified by the introduction of additional layers between the core and outer cover layer. If one additional layer is introduced between the core and outer cover layer, a so called "three-piece ball" results, and similarly, if two additional layers are introduced between the core and outer cover layer, a so called "four-piece ball" results, and so on.

Balata was used as the primary material for covers of golf balls until the 1960's when SURLYN®, an ionomeric resin made by E.I. DuPont de Nemours & Co., was introduced to the golf industry. Ionomers typically cost less than balata and have better cut or shear resistance. At the present time, ionomers are used as the primary polymer source for either or both of the cover stock and intermediate layers for most two-piece and some three-piece golf balls. The problem with ionomer-covered golf balls, however, is that they often lack the "click" and "feel" which golfers had become accustomed to with balata. "Click" is the sound made when the ball is hit by a golf club while "feel" is the overall sensation imparted to the golfer when the ball is hit.

However, unlike ionomer-covered golf balls, polyurethane- or polyurea-covered golf balls can be made to have the "click" and "feel" of balata and the cut or shear resistance of ionomer. Polyurethanes or polyureas are typically prepared by the reaction of a diisocyanate with a polyol (in the case of polyurethanes) or with a polyamine (in the case of a polyurea). Thermoplastic polyurethanes or polyureas may consist solely of this initial mixture or may be further combined with a chain extender to vary properties such as hardness of the thermoplastic. Thermoset polyurethanes or polyureas typically are formed by the reaction of a diisocyanate and a polyol or polyamine respectively, and an additional crosslinking agent to crosslink or cure the material to result in a thermoset.

One measure of a golf ball's performance is its resilience which is related to the balls Coefficient of Restitution ("COR"). The C.O.R. of a one-piece golf ball is a function of its composition. In two-piece golf balls and multi-layered golf balls, the C.O.R. is a function of the various properties of the core, the cover, and any additional layer. Although the United States Golf Association (U.S.G.A.) has not promulgated any limitations on the C.O.R. values for golf balls, it has instituted a rule prohibiting the competitive use in any U.S.G.A.-sanctioned event of a golf ball that can achieve an initial velocity greater than 76.2 meters per second (m/s), or 250 ft/s, when struck by a golf club driver having a velocity of 39.6 m/s, i.e., 130 ft/s (referred to hereinafter as "the U.S.G.A. test"). However, an allowed tolerance of two percent permits manufacturers to produce golf balls that achieve an initial velocity of 77.7 m/s (255 ft/s).

Players generally seek a ball that delivers maximum distance, which requires a high initial velocity upon impact. Therefore, in an effort to meet the demands of the marketplace, golf ball manufacturers strive to produce balls delivering initial velocities in the U.S.G.A. test that approximate the U.S.G.A. maximum of 77.7 m/s, or 255 ft/s, as closely as possible. Golf ball manufacturers also generally strive to maximize the ball's C.O.R. without violating the velocity limitation. Also, to maximize distance, it is advantageous if the balls have a lower driver spin rate. Finally it is highly desirable if, while providing increased velocity and distance, the balls also will exhibit a soft shot feel.

Recent multi-layer ball constructions have attempted to overcome some of the undesirable aspects of conventional two-piece balls, e.g., their hard feel. Such a multi-layer structure allows the introduction of new materials of varying hardness, whereby deficiencies in a property in one layer can be mitigated by the introduction of a different material in another layer. For example, to optimize ball hardness and "feel," blends of copolymeric high-acid ionomers with softer terpolymeric ionomers have been used as a layer material in a golf ball but again, often with a concurrent loss of C.O.R. and/or speed.

Numerous examples of multi-layer combinations are available. For example, U.S. Pat. No. 4,431,193 discloses a golf ball having a multi-layer cover, in which the inner cover layer is a relatively hard, high flexural modulus ionomer resin and the outer cover layer is a relatively soft, low flexural modulus ionomer resin.

Also, U.S. Pat. No. 6,368,237 discloses a multi-layer golf ball comprising a core, an inner cover layer, and an outer cover layer. The inner cover layer comprises a high-acid ionomer or ionomer blend. The outer cover layer comprises a soft, very low-modulus ionomer or ionomer blend, or a non-ionomeric thermoplastic elastomer such as polyurethane, polyester, or polyesteramide. The resulting multi-layer golf ball is said to provide an enhanced distance without sacrificing playability or durability when compared to known multi-layer golf balls.

U.S. Pat. Nos. 6,416,424, 6,416,424, and 6,419,594, likewise, disclose multi-layer golf balls comprising a core, an inner cover layer, and an outer cover layer. The inner cover layer comprises a low-acid ionomer blend. The outer cover layer comprises a soft, very low modulus ionomer or ionomer blend, or a non-ionomeric thermoplastic elastomer such as polyurethane, polyester, or polyesteramide. The resulting multi-layer golf ball is said to provide an enhanced distance without sacrificing playability or durability when compared to known multi-layer golf balls.

U.S. Pat. Nos. 6,503,156 and 6,506,130, likewise, disclose multi-layer golf balls comprising a core, an inner cover layer, and an outer cover layer. The inner cover layer comprises a low-acid ionomer blend. The outer cover layer comprises a soft, non-ionomeric thermoplastic or thermosetting elastomer such as polyurethane, polyester, or polyesteramide. The resulting multi-layered golf ball is said to provide an enhanced distance without sacrificing playability or durability when compared to known multi-layer golf balls.

Another approach to optimizing golf ball performance has been to incorporate selected additives into the polymer compositions used to make the various ball layers, in order to modify the polymer properties. Such additives include the metal salts of various fatty acids. For example, U.S. Pat. Nos. 5,312,857 and 5,306,760 disclose cover compositions for golf ball construction comprising mixtures of ionomer resins and 25-100 parts by weight of various fatty acid salts (i.e., metal stearates, metal oleates, metal palmitates, metal pelargonates, metal laurates, etc.). However, the patents fail to disclose any major effects on ball properties, and fail to disclose that the compositions are useful for parts of a golf ball other than the cover.

Recent attempts to extend the concept of the use of multilayer covers to mitigate the harsh feel of the harder ionomer materials have also resulted in the development of modified ionomers for use in golf ball compositions. For instance, U.S. Pat. No. 6,100,321 and U.S. Patent Publication No. 2003/0158312 A1 disclose ionomer compositions that are modified with 25 to 100 parts by weight of a fatty acid salt such as a metal stearate, for producing golf balls having good resilience and high softness. Unlike the earlier-mentioned patents, which have employed metal stearates as a filler material, U.S. Pat. No. 6,100,321 and U.S. Patent Publication No. 2003/0158312 A1 contemplates the use of relatively low levels of a stearic acid moiety, particularly metal stearates, to modify ionomers to produce improved resilience for a given level of hardness or PGA Compression values. The stearate-modified ionomers are taught as being especially useful when the ionomer is formulated for use as a golf ball core or center, as a one-piece golf ball, or as a soft golf ball cover. However, there is no disclosure of any ball construction parameters required to produce specific performance properties such as driver velocity or driver spin for three-piece balls.

Subsequent patents have furthered the use of such modified ionomers in golf ball covers. For example, U.S. Pat. No. 6,329,458 discloses a golf ball cover comprising an ionomer resin and a metal "soap," e.g., calcium stearate. Finally, U.S. Pat. No. 6,616,552 discloses a golf ball including a multilayer cover, one layer of which includes a heated mixture of an ionomer resin and a metal salt of a fatty acid, e.g., calcium stearate.

It should be appreciated from the foregoing description that there remains a need for a golf ball that can provide maximum C.O.R. without violating the velocity limitation. Also, to maximize distance, it is desirable for such balls to have a lower driver spin rate and to exhibit a soft shot feel. The present invention satisfies this need.

SUMMARY

Disclosed herein in one embodiment is a golf ball comprising;

1) a core comprising a center, 2) an outer cover layer; and 3) one or more intermediate layers, wherein at least one of the core, outer cover layer, or intermediate layer comprises a blend composition of;

(A) from about 50 to about 95 wt % (based on the combined weight of Components A and B) of a polyamide; and (B) from about 5 to about 50 wt % (based on the combined weight of Components A and B) of one or more functional polymer modifiers selected from the group consisting of a copolymer having a glycidyl group, hydroxyl group, maleic anhydride group or carboxylic group, or a terpolymer having a glycidyl group, hydroxyl group, maleic anhydride group or carboxylic group, and mixtures thereof; and wherein said blend composition has a flexural modulus of from about 5 to about 500 kpsi, a Shore D hardness of from about 25 to about 85, and a tensile elongation of at least about 20%.

Another embodiment disclosed herein is a golf ball having a core, an intermediate layer and outer cover layer and wherein;

1) the intermediate layer comprises a blend composition of;

(A) from about 50 to about 95 wt % (based on the combined weight of Components A and B) of a polyamide; and (B) from about 5 to about 50 wt % (based on the combined weight of Components A and B) of one or more functional polymer modifiers selected from the group consisting of a copolymer having a glycidyl group, hydroxyl group, maleic anhydride group or carboxylic group, or a terpolymer having a glycidyl group, hydroxyl group, maleic anhydride group or carboxylic group, and mixtures thereof;

and wherein said blend composition has a flexural modulus of from about 5 to about 500 kpsi, a Shore D hardness of from about 25 to about 85, and a tensile elongation of at least about 20%; and 2) the outer cover layer comprises one or more thermoset polyurethane, thermoset polyurea, thermoplastic polyurethane, thermoplastic polyurea, ionomer, block copolymer, ethylene/(meth)acrylic acid copolymer, or ethylene/(meth) acrylic acid/alkyl (meth)acrylate terpolymer.

A further embodiment disclosed herein is a golf ball having a core, an inner intermediate layer, an outer intermediate layer and an outer cover layer and wherein;

1) one or both of the inner and outer intermediate layers comprises a blend composition of;

(A) from about 50 to about 95 wt % (based on the combined weight of Components A and B) of a polyamide; and (B) from about 5 to about 50 wt % (based on the combined weight of Components A and B) of one or more functional polymer modifiers selected from the group consisting of a copolymer having a glycidyl group, hydroxyl group, maleic anhydride group or carboxylic group, or a terpolymer having a glycidyl group, hydroxyl group, maleic anhydride group or carboxylic group, and mixtures thereof;

and wherein said blend composition has a flexural modulus of from about 5 to about 500 kpsi, a Shore D hardness of from about 25 to about 85, and a tensile elongation of at least about 20%; and 2) the outer cover layer comprises one or more thermoset polyurethane, thermoset polyurea, thermoplastic polyurethane, thermoplastic polyurea, ionomer, block copolymer, ethylene/(meth)acrylic acid copolymer, or ethylene/(meth)acrylic acid/alkyl (meth)acrylate terpolymer.

BRIEF DESCRIPTION OF DRAWINGS

Although FIGS. 1 and 2 illustrate only three- and four-piece golf ball constructions, golf balls of the present invention may comprise from 1 to at least 5 intermediate layer(s), preferably from 1 to 3 intermediate layer(s), more preferably from 1 to 2 intermediate layer(s).

DETAILED DESCRIPTION

Figure 1:
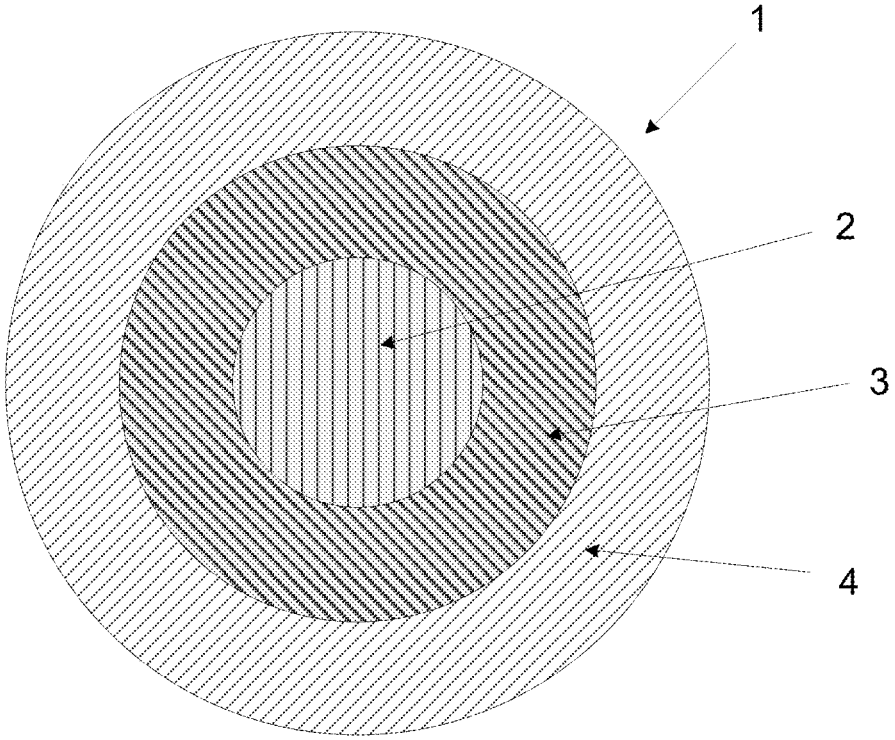
FIG. 1 illustrates a three-piece golf ball 1 comprising a solid center or core 2, an intermediate layer 3, and an outer cover layer 4.
Figure 2:
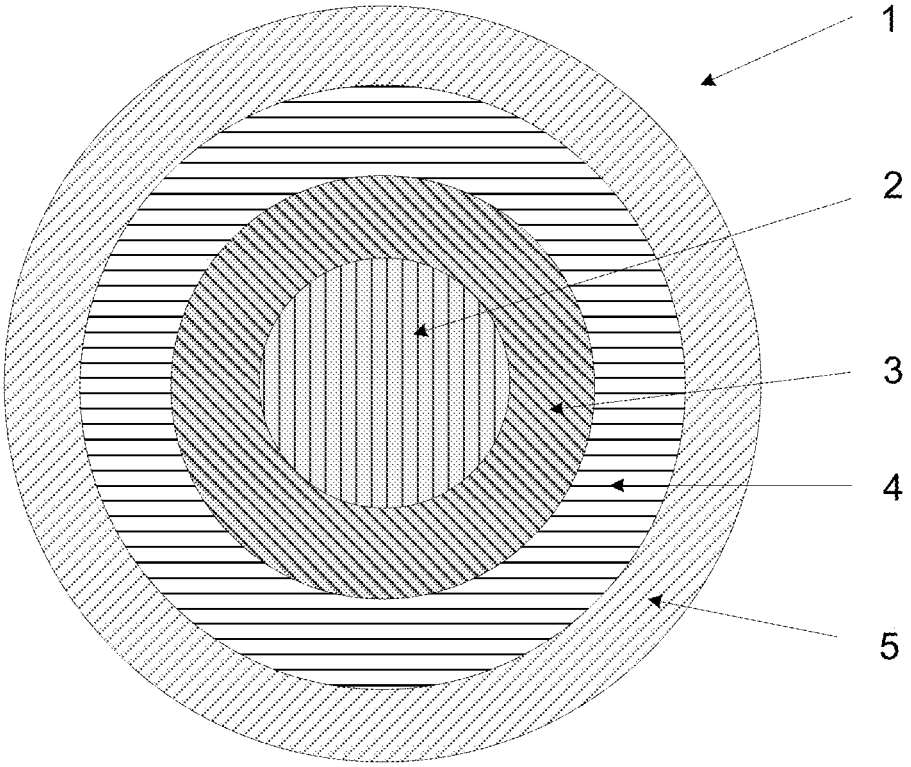
FIG. 2 illustrates a 4-piece golf ball 1 comprising a core 2, and an outer cover layer 5, an inner intermediate layer 3, and an outer intermediate layer 4.

Disclosed herein are golf balls and golf ball components comprising a blend of one or more polyamides mixed with one or more functional polymer modifiers. As used herein, a "blend" or "blend composition" can be a physical mixture of components A and B and/or a reaction product produced by a reaction between components A and B. When used in golf ball covers or mantles, these materials exhibit improved impact durability when compared to ionomers or polyurethanes of similar hardness. These materials even at high modulus (>100,000 psi) still exhibit little brittleness and improved toughness. In addition, although the COR of these materials (material COR measured on sphere) is lower than that of high acid ionomers, we have unexpectedly found that when these materials are used to make a mantle layer, the resulting ball COR is comparable or better to the analogous ball made with the high acid ionomer mantle. While not being held to any theory it is believed that this enhanced ball COR reflects the synergistic combination of the material's high modulus combined with its elasticity.

The following definitions are provided to aid the reader, and are not intended to provide term definitions that would be narrower than would be understood by a person of ordinary skill in the art of golf ball composition and manufacture.

Any numerical values recited herein include all values from the lower value to the upper value. All possible combinations of numerical values between the lowest value and the highest value enumerated herein are expressly included in this application.

As used herein, the term "core" is intended to mean the elastic center of a golf ball, which may have a unitary construction. Alternatively the core itself may have a layered construction, e.g. having a spherical "center" and additional "core layers," with such layers being made of the same material or a different material from the core center.

The term "cover" is meant to include any layer of a golf ball that surrounds the core. Thus a golf ball cover may include both the outermost layer and also any inner cover layers, which are disposed between the golf ball center and outer cover layer. "Cover" may be used interchangeably with the term "cover layer".

The term "intermediate layer" may be used interchangeably with "mantle layer," "inner cover layer" or "inner cover" and is intended to mean any layer(s) in a golf ball disposed between the core and the outer cover layer. In the case of a ball with two intermediate layers, the term "inner intermediate layer" may be used interchangeably herein with the terms "inner mantle" or "inner mantle layer" and is intended to mean the intermediate layer of the ball positioned nearest to the core.

The term "outer cover layer" is intended to mean the outermost cover layer of the golf ball on which, for example, the dimple pattern, paint and any writing, symbol, etc. is placed. If, in addition to the core, a golf ball comprises two or more cover layers, only the outermost layer is designated the outer cover layer. The remaining layers may be designated intermediate layers. The term outer cover layer is interchangeable with the term "outer cover".

In the case of a ball with two intermediate layers, the term "outer intermediate layer" may be used interchangeably herein with the terms "outer mantle" or "outer mantle layer" and is intended to mean the intermediate layer of the ball which is disposed nearest to the outer cover layer.

The term "polyamide" as used herein includes both homopolyamides and copolyamides. Illustrative polyamides for use in the polyamide compositions include those obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, decamethylenediamine, 1,4-cyclohexyldiamine or m-xylylenediamine; (2) a ring-opening polymerization of cyclic lactam, such as ϵ-caprolactam or ω-laurolactam; (3) polycondensation of an aminocarboxylic acid, such as 6-aminocaproic acid, 9-aminononanoic acid, 11-aminoundecanoic acid or 12-aminododecanoic acid; (4) copolymerization of a cyclic lactam with a dicarboxylic acid and a diamine; or any combination of (1)-(4). In certain examples, the dicarboxylic acid may be an aromatic dicarboxylic acid or a cycloaliphatic dicarboxylic acid. In certain examples, the diamine may be an aromatic diamine or a cycloaliphatic diamine. Specific examples of suitable polyamides include polyamide 6; polyamide 11; polyamide 12; polyamide 4,6; polyamide 6,6; polyamide 6,9; polyamide 6,10; polyamide 6,12; polyamide MXD6; PA12, CX; PA12, IT; PPA; PA6, IT; and PA6/PPE.

One example of a group of suitable polyamides are thermoplastic polyamide elastomers. Thermoplastic polyamide elastomers typically are copolymers of a polyamide and polyester or polyether. For example, the thermoplastic polyamide elastomer can contain a polyamide (Nylon 6, Nylon 66, Nylon 11, Nylon 12 and the like) as a hard segment and a polyether or polyester as a soft segment. In one specific example, the thermoplastic polyamides are amorphous copolyamides based on polyamide (PA 12).

One class of copolyamide elastomers are polyether amide elastomers. Illustrative examples of polyether amide elastomers are those that result from the copolycondensation of polyamide blocks having reactive chain ends with polyether blocks having reactive chain ends, including:

(1) polyamide blocks of diamine chain ends with polyoxyalkylene sequences of dicarboxylic chains;

(2) polyamide blocks of dicarboxylic chain ends with polyoxyalkylene sequences of diamine chain ends obtained by cyanoethylation and hydrogenation of polyoxyalkylene alpha-omega dihydroxylated aliphatic sequences known as polyether diols; and (3) polyamide blocks of dicarboxylic chain ends with polyether diols, the products obtained, in this particular case, being polyetheresteramides.

More specifically, the polyamide elastomer can be prepared by polycondensation of the components (i) a diamine and a dicarboxylate, lactames or an amino dicarboxylic acid (PA component), (ii) a polyoxyalkylene glycol such as polyoxyethylene glycol, polyoxy propylene glycol (PG component) and (iii) a dicarboxylic acid.

The polyamide blocks of dicarboxylic chain ends come, for example, from the condensation of alpha-omega aminocarboxylic acids of lactam or of carboxylic diacids and diamines in the presence of a carboxylic diacid which limits the chain length. The molecular weight of the polyamide sequences is preferably between about 300 and 15,000, and more preferably between about 600 and 5,000. The molecular weight of the polyether sequences is preferably between about 100 and 6,000, and more preferably between about 200 and 3,000.

The amide block polyethers may also comprise randomly distributed units. These polymers may be prepared by the simultaneous reaction of polyether and precursor of polyamide blocks. For example, the polyether diol may react with a lactam (or alpha-omega amino acid) and a diacid which limits the chain in the presence of water. A polymer is obtained that has primarily polyether blocks and/or polyamide blocks of very variable length, but also the various reactive groups that have reacted in a random manner and which are distributed statistically along the polymer chain.

Suitable amide block polyethers include those as disclosed in U.S. Pat. Nos. 4,331,786; 4,115,475; 4,195,015; 4,839,441; 4,864,014; 4,230,848 and 4,332,920, the contents of each of which are herein incorporated by reference.

The polyether may be, for example, a polyethylene glycol (PEG), a polypropylene glycol (PPG), or a polytetramethylene glycol (PTMG), also designated as polytetrahydrofurane (PTHF). The polyether blocks may be along the polymer chain in the form of diols or diamines. However, for reasons of simplification, they are designated PEG blocks, or PPG blocks, or also PTMG blocks.

The polyether block comprises different units such as units which derive from ethylene glycol, propylene glycol, or tetramethylene glycol.

The amide block polyether comprises at least one type of polyamide block and one type of polyether block. Mixing of two or more polymers with polyamide blocks and polyether blocks may also be used. The amide block polyether also can comprise any amide structure made from the method described on the above.

Preferably, the amide block polyether is such that it represents the major component in weight, i.e., that the amount of polyamide which is under the block configuration and that which is eventually distributed statistically in the chain represents 50 weight percent or more of the amide block polyether. Advantageously, the amount of polyamide and the amount of polyether is in a ratio (polyamide/polyether) of 1/1 to 3/1.

One type of polyetherester elastomer is the family of Pebax resins, which are available from Elf-Atochem Company. Preferably, the choice can be made from among Pebax 2533, 3533, 4033, 1205, 7033 and 7233 and blends therefrom. Pebax 2533 has a hardness of about 25 shore D (according to ASTM D-2240), a Flexural Modulus of 2.1 kpsi (according to ASTM D-790), and a Bayshore resilience of about 62% (according to ASTM D-2632). Pebax 3533 has a hardness of about 35 shore D (according to ASTM D-2240), a Flexural Modulus of 2.8 kpsi (according to ASTM D-790), and a Bayshore resilience of about 59% (according to ASTM D-2632). Pebax 7033 has a hardness of about 69 shore D (according to ASTM D-2240) and a Flexural Modulus of 67 kpsi (according to ASTM D-790). Pebax 7333 has a hardness of about 72 shore D (according to ASTM D-2240) and a flexural modulus of 107 kpsi (according to ASTM D-790).

Some examples of suitable polyamides for use in the compositions of the present invention include those commercially available under the tradenames CRISTAMID and RILSAN marketed by Atofina Chemicals of Philadelphia, Pa., GRIVORY and GRILAMID marketed by EMS Chemie of Sumter, S.C., TROGAMID and VESTAMID available from Degussa, and ZYTEL marketed by E.I. DuPont de Nemours & Co., of Wilmington, Del.

Most preferred polyamides comprise aromatic, aliphatic and cycloaliphatic blocks with aliphatic and cycloaliphatic blocks being more preferred. An especially preferred thermoplastic polyamide is based on polyamide 12 including polyamides made by substantially equimolar mixing of (bis(methyl-para-aminocyclohexyl)methane) (BMACM) and of dodecanedioic acid. The polymer obtained, Polyamide BMACM.12, is transparent, exhibits good mechanical properties and exhibits stress crack resistance in the presence of alcohols. Its glass transition temperature, measured by DSC, is 155° C., and it absorbs 3.0% by weight of water at 23° C. Polyamide BMACM.12, is commercially available from EMS Chemie under the tradename TR90.

Functional Polymer Modifier

As discussed above, the functional polymer modifier of the polyamide used in the ball covers or intermediate layers can include copolymers or terpolymers having a glycidyl group, hydroxyl group, maleic anhydride group or carboxylic group, collectively referred to as functionalized polymers. These copolymers and terpolymers may comprise an α-olefin. Examples of suitable α-olefins include ethylene, propylene, 1-butene, 1-pentene, 3-methyl-1-butene, 1-hexene, 4-methyl-1-petene, 3-methyl-1-pentene, 1-octene, 1-decene-, 1-dodecene, 1-tetradecene, 1-hexadecene, 1-octadecene, 1-eicocene, 1-dococene, 1-tetracocene, 1-hexacocene, 1-octacocene, and 1-triacontene. One or more of these α-olefins may be used.

Examples of suitable glycidyl groups in copolymers or terpolymers in the polymeric modifier include esters and ethers of aliphatic glycidyl, such as allylglycidylether, vinylglycidylether, glycidyl maleate and itaconatem glycidyl acrylate and methacrylate, and also alicyclic glycidyl esters and ethers, such as 2-cyclohexene-1-glycidylether, cyclohexene-4,5 diglyxidylcarboxylate, cyclohexene-4-glycidyl carobxylate, 5-norboenene-2-methyl-2-glycidyl carboxylate, and endocis-bicyclo(2,2,1)-5-heptene-2,3-diglycidyl dicarboxylate. These polymers having a glycidyl group may comprise other monomers, such as esters of unsaturated carboxylic acid, for example, alkyl(meth)acrylates or vinyl esters of unsaturated carboxylic acids. Polymers having a glycidyl group can be obtained by copolymerization or graft polymerization with homopolymers or copolymers.

Examples of suitable terpolymers having a glycidyl group include LOTADER AX8900 and AX8920, marketed by Atofina Chemicals, ELVALOY marketed by E.I. Du Pont de Nemours & Co., and REXPEARL marketed by Nippon Petrochemicals Co., Ltd. Additional examples of copolymers comprising epoxy monomers and which are suitable for use within the scope of the present invention include styrene-butadiene-styrene block copolymers in which the polybutadiene block contains epoxy group, and styrene-isoprene-styrene block copolymers in which the polyisoprene block contains epoxy. Commercially available examples of these epoxy functional copolymers include ESBS A1005, ESBS A1010, ESBS A1020, ESBS AT018, and ESBS AT019, marketed by Daicel Chemical Industries, Ltd.

Examples of polymers or terpolymers incorporating a maleic anhydride group suitable for use within the scope of the present invention include maleic anhydride-modified ethylene-propylene copolymers, maleic anhydride-modified ethylene-propylene-diene terpolymers, maleic anhydride-modified polyethylenes, maleic anhydride-modified polypropylenes, ethylene-ethylacrylate-maleic anhydride terpolymers, and maleic anhydride-indene-styrene-cumarone polymers. Examples of commercially available copolymers incorporating maleic anhydride include: BONDINE, marketed by Sumitomo Chemical Co., such as BONDINE AX8390, an ethylene-ethyl acrylate-maleic anhydride terpolymer having a combined ethylene acrylate and maleic anhydride content of 32% by weight, and BONDINE TX TX8030, an ethylene-ethyl acrylate-maleic anhydride terpolymer having a combined ethylene acrylate and maleic anhydride content of 15% by weight and a maleic anhydride content of 1% to 4% by weight; maleic anhydride-containing LOTADER 3200, 3210, 6200, 8200, 3300, 3400, 3410, 7500, 5500, 4720, and 4700, marketed by Atofina Chemicals; EXXELOR VA1803, a maleic anyhydride-modified ethylene-propylene copolymer having a maleic anyhydride content of 0.7% by weight, marketed by Exxon Chemical Co.; and KRATON FG 1901X, a maleic anhydride functionalized triblock copolymer having polystyrene endblocks and poly(ethylene/butylene) midblocks, marketed by Shell Chemical.

Preferably the functional polymer component is a maleic anhydride grafted polymers preferably maleic anhydride grafted polyolefins (for example, Exxellor VA1803).

Other polymeric materials generally considered useful for making golf balls may also be included in one or more of the components of the golf balls of the present invention. These include, without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamer, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene/propylene-styrene (SEPS).), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference in its entirety), ethylene vinyl acetates, polyureas, and polysiloxanes and any and all combinations thereof.

One preferred material which may be used as a component of the cover layer or intermediate layer of the golf balls of the present invention includes the family of thermoset polyurethanes or polyureas. These are made by the combination of a polyisocyanate with a polyol (in the case of polyurethanes) or a polyamine (in the case of polyureas) followed by subsequent reaction with a curing agent.

Any polyisocyanate available to one of ordinary skill in the art is suitable for use according to the invention including, but not limited to, aliphatic, cycloaliphatic, aromatic aliphatic, aromatic polyisocyanates, any derivatives thereof, and combinations of these compounds having two or more isocyanate (NCO) groups per molecule.

Any polyol available to one of ordinary skill in the polyurethane art is suitable for use according to the invention. Suitable polyols include, but are not limited to, polyester polyols, polyether polyols use, polycarbonate polyols and polydiene polyols such as polybutadiene polyols.

Any polyamine available to one of ordinary skill in the polyurethane art is suitable for use according to the invention. Suitable polyamines include, but are not limited to, amine-terminated hydrocarbons, amine-terminated polyethers, amine-terminated polyesters, amine-terminated polycaprolactones, amine-terminated polycarbonates, amine-terminated polyamides, and mixtures thereof. The amine-terminated compound may be a polyether amine selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof.

The previously described polyisocyanate and polyol or polyamine components may be initially combined to form a prepolymer prior to reaction with the curing agent. Any such prepolymer combination is suitable for use in the present invention and are commercially available from Uniroyal Chemical Company of Middlebury, Conn., under the trade name ADIPRENE® and include LFH580, LFH120, LFH710, LFH1570, LF930A, LF950A, LF601D, LF751D, LFG963A, LFG640D.

Polyol curing agents may be primary, secondary, or tertiary polyols. Non-limiting examples of monomers of these polyols include: trimethylolpropane (TMP), ethylene glycol, 1,3-propanediol, 1,4-butanediol, 1,5-pentanediol, 1,6-hexanediol, propylene glycol, dipropylene glycol, 1,2-butanediol, 1,3-butanediol, 2,3-butanediol, 1,2-pentanediol, 2,3-pentanediol, 2,5-hexanediol, 2,4-hexanediol, 2-ethyl-1,3-hexanediol, cyclohexanediol, and 2-ethyl-2-(hydroxymethyl)-1,3-propanediol. Diamines also can be added to urethane prepolymer to function as chain extenders.

Polyamine curing agents include primary, secondary and tertiary amines having two or more amines as functional groups. Examples of these include: aliphatic diamines, such as tetramethylenediamine, pentamethylenediamine, hexamethylenediamine; alicyclic diamines, such as 3,3'-dimethyl-4,4'-diamino-dicyclohexyl methane; or aromatic diamines, such as diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis(2-hydroxypropyl)ethylenediamine, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, 4,4'-methylene bis-2-chloroaniline, 2,2',3,3'-tetrachloro-4,4'-diamino-phenyl methane, p,p'-methylenedianiline, p-phenylenediamine or 4,4'-diaminodiphenyl; and 2,4,6-tris(dimethylaminomethyl) phenol.

Depending on their chemical structure, curing agents may be slow- or fast-reacting polyamines or polyols. As described in U.S. Pat. Nos. 6,793,864, 6,719,646 and copending US Patent Publication No. 2004/0201133 A1, (the contents of all of which are hereby incorporated herein by reference), slow-reacting polyamines are diamines that have amine groups which are sterically and/or electronically hindered by electron withdrawing groups or bulky groups situated proximate to the amine reaction sites. The spacing of the amine reaction sites will also affect the reactivity speed of the polyamines.

A dicyandiamide may be used either alone or in a blend with either a slower or faster curing agent. Suitable dicyandiamides are described U.S. patent application Ser. No. 11/809,432, filed on 31 May, 2007, the entire contents of which are herein incorporated by reference.

Under some circumstances it is advantageous to have polyurethane or polyurea formulations which are able to cure as a thermoset but only within a specified temperature range which is above that of the typical injection molding process. This allows parts, such as golf ball cover layers, to be initially injection molded, followed by subsequent processing at higher temperatures and pressures to induce further crosslinking and curing, resulting in thermoset properties in the final part. Such an initially injection moldable composition is thus called a post curable urethane or urea composition.

If such a post curable urethane or urea composition is required, a modified or blocked diisocyanate which subsequently unblocks and induces further cross linking post extrusion may be included in the diisocyanate starting material. Such modified diisocyanates are described in more detail in U.S. Pat. No. 6,939,924, the entire contents of which are hereby incorporated by reference.

As an alternative if a post curable polyurethane or polyurea composition is required, the diisocyanate may further comprise reaction product of a nitroso compound and a diisocyanate or a polyisocyanate. The reaction product has a characteristic temperature at which it decomposes regenerating the nitroso compound and diisocyanate or polyisocyanate, which can, by judicious choice of the post processing temperature, in turn induce further crosslinking in the originally thermoplastic composition resulting in thermoset-like properties. Such nitroso compounds are described in more detail in U.S. Pat. No. 7,037,985 B2, the entire contents of which are hereby incorporated by reference.

If a post curable composition is required the chain extender or curing agent can further comprise a peroxide or peroxide mixture. Before the composition is exposed to sufficient thermal energy to reach the activation temperature of the peroxide, the composition of (a) and (b) behaves as a thermoplastic material. Therefore, it can readily be formed into golf ball layers using injection molding. However, when sufficient thermal energy is applied to bring the composition above the peroxide activation temperature, crosslinking occurs, and the thermoplastic polyurethane is converted into crosslinked polyurethane. Further details of this post curable system are disclosed in U.S. Pat. No. 6,924,337, the entire contents of which are hereby incorporated by reference.

Another preferred material for the outer cover and/or one or intermediate layers of the golf balls of the present invention includes the various ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a monoolefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer". The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with the $Li^+$, $Na^+$, $Ca^{2+}$, $Zn^{2+}$, and $Mg^{2+}$ being preferred. The basic metal ion salts include those of for example formic acid, acetic acid, nitric acid, and carbonic acid, hydrogen carbonate salts, oxides, hydroxides, and alkoxides.

The first commercially available ionomer resins contained up to 16 weight percent acrylic or methacrylic acid, although it was also well known at that time that, as a general rule, the hardness of these cover materials could be increased with increasing acid content. Hence, in Research Disclosure 29703, published in January 1989, DuPont disclosed ionomers based on ethylene/acrylic acid or ethylene/methacrylic acid containing acid contents of greater than 15 weight percent. In this same disclosure, DuPont also taught that such so called "high acid ionomers" had significantly improved stiffness and hardness and thus could be advantageously used in golf ball construction, when used either singly or in a blend with other ionomers.

More recently, high acid ionomers can be ionomer resins with acrylic or methacrylic acid units present from 16 wt. % to about 35 wt. % in the polymer. Generally, such a high acid ionomer will have a flexural modulus from about 50,000 psi to about 125,000 psi.

Ionomer resins further comprising a softening comonomer, present from about 10 wt. % to about 50 wt. % in the polymer, have a flexural modulus from about 2,000 psi to about 10,000 psi, and are sometimes referred to as "soft" or "very low modulus" ionomers. Typical softening comonomers include n-butyl acrylate, iso-butyl acrylate, n-butyl methacrylate, methyl acrylate and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf ball component. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ $\alpha,\beta$ ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said ionomeric polymer are partially neutralized with a metal selected from the group consisting of lithium, sodium, potassium, magnesium, calcium, barium, lead, tin, zinc or aluminum, or a combination of such cations.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights. Specifically they include bimodal polymer blend compositions comprising:

a) a high molecular weight component having a weight average molecular weight ($M_w$) of about 80,000 to about 500,000 and comprising one or more ethylene/$\alpha$, $\beta$-ethylenically unsaturated $C_{3-8}$ carboxylic acid copolymers and/or one or more ethylene, alkyl (meth)acrylate, (meth)acrylic acid terpolymers; said high molecular weight component being partially neutralized with metal ions selected from the group consisting of lithium, sodium, zinc, calcium, magnesium, and a mixture of any these; and b) a low molecular weight component having a weight average molecular weight ($M_w$) of about from about 2,000 to about 30,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and a mixture of any these.

In addition to the unimodal and bimodal ionomers, also included are the so-called "modified ionomers" examples of which are described in U.S. Pat. Nos. 6,100,321, 6,329,458 and 6,616,552 and U.S. Patent Publication US 2003/0158312 A1, the entire contents of all of which are herein incorporated by reference.

The modified unimodal ionomers may be prepared by mixing:

a) an ionomeric polymer comprising ethylene, from 5 to 25 weight percent (meth)acrylic acid, and from 0 to 40 weight percent of a (meth)acrylate monomer, said ionomeric polymer neutralized with metal ions selected from the group consisting of lithium, sodium, potassium, magnesium, calcium, barium, lead, tin, zinc or aluminum, and any and all mixtures thereof; and b) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

The modified bimodal ionomers, which are ionomers derived from the earlier described bimodal ethylene/carboxylic acid polymers (as described in U.S. Pat. No. 6,562,906, the entire contents of which are herein incorporated by reference), are prepared by mixing;

a) a high molecular weight component having a weight average molecular weight ($M_w$) of about 80,000 to about 500,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said high molecular weight component being partially neutralized with metal ions selected from the group consisting of lithium, sodium, potassium, magnesium, calcium, barium, lead, tin, zinc or aluminum, and any and all mixtures thereof; and b) a low molecular weight component having a weight average molecular weight ($M_w$) of about from about 2,000 to about 30,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and any and all mixtures thereof; and c) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

The fatty or waxy acid salts utilized in the various modified ionomers are composed of a chain of alkyl groups containing from about 4 to 75 carbon atoms (usually even numbered) and characterized by a —COOH terminal group. The generic formula for all fatty and waxy acids above acetic acid is $CH_3$ $(CH_2)_x$ COOH, wherein the carbon atom count includes the carboxyl group (i.e. x=2-73). The fatty or waxy acids utilized to produce the fatty or waxy acid salts modifiers may be saturated or unsaturated, and they may be present in solid, semi-solid or liquid form.

Examples of suitable saturated fatty acids, i.e., fatty acids in which the carbon atoms of the alkyl chain are connected by single bonds, include but are not limited to stearic acid ($C_{18}$, i.e., $CH_3$ $(CH_2)_{16}$ COOH), palmitic acid ($C_{16}$, i.e., $CH_3$ $(CH_2)_{14}$ COOH), pelargonic acid ($C_9$, i.e., $CH_3$ $(CH_2)_7$ COOH) and lauric acid ($C_{12}$, i.e., $CH_3$ $(CH_2)_{10}$ OCOOH). Examples of suitable unsaturated fatty acids, i.e., a fatty acid in which there are one or more double bonds between the carbon atoms in the alkyl chain, include but are not limited to oleic acid ($C_{13}$, i.e., $CH_3$ $(CH_2)_7$ CH:CH$(CH_2)_7$ COOH).

The source of the metal ions used to produce the metal salts of the fatty or waxy acid salts used in the various modified ionomers are generally various metal salts which provide the metal ions capable of neutralizing, to various extents, the carboxylic acid groups of the fatty acids. These include the sulfate, carbonate, acetate and hydroxylate salts of zinc, barium, calcium and magnesium.

Since the fatty acid salts modifiers comprise various combinations of fatty acids neutralized with a large number of different metal ions, several different types of fatty acid salts may be utilized in the invention, including metal stearates, laureates, oleates, and palmitates, with calcium, zinc, sodium, lithium, potassium and magnesium stearate being preferred, and calcium and sodium stearate being most preferred.

The fatty or waxy acid or metal salt of said fatty or waxy acid is present in the modified ionomeric polymers in an amount of from about 5 to about 40, preferably from about 7 to about 35, more preferably from about 8 to about 20 weight percent (based on the total weight of said modified ionomeric polymer).

As a result of the addition of the one or more metal salts of a fatty or waxy acid, from about 40 to 100, preferably from about 50 to 100, more preferably from about 70 to 100 percent of the acidic groups in the final modified ionomeric polymer composition are neutralized by a metal ion.

An example of such a modified ionomer polymer is DuPont® HPF-1000 available from E. I. DuPont de Nemours and Co. Inc.

A preferred ionomer composition may be prepared by blending one or more of the unimodal ionomers, bimodal ionomers, or modified unimodal or bimodal ionomeric polymers as described herein, and further blended with a zinc neutralized ionomer of a polymer of general formula E/X/Y where E is ethylene, X is a softening comonomer such as acrylate or methacrylate and is present in an amount of from 0 to about 50, preferably 0 to about 25, most preferably 0, and Y is acrylic or methacrylic acid and is present in an amount from about 5 wt. % to about 25, preferably from about 10 to about 25, and most preferably about 10 to about 20 wt % of the total composition.

In yet another aspect, another preferred material which may be used as a component of the cover layer or intermediate layer of the golf balls of the present invention a blend of an ionomer and a block copolymer can be included in the composition. Examples of such block copolymers include styrenic block copolymers including styrene-butadiene-styrene (SBS), styrene-ethylene-butylene-styrene, (SEBS) and styrene-ethylene/propylene-styrene (SEPS). Also included are functionalized styrenic block copolymers, including those where the block copolymer incorporates a first polymer block having an aromatic vinyl compound, a second polymer block having a conjugated diene compound and a hydroxyl group located at a block copolymer, or its hydrogenation product, and in which the ratio of block copolymer to ionomer ranges from 5:95 to 95:5 by weight, more preferably from about 10:90 to about 90:10 by weight, more preferably from about 20:80 to about 80:20 by weight, more preferably from about 30:70 to about 70:30 by weight and most preferably from about 35:65 to about 65:35 by weight. A preferred functionalized styrenic block copolymer is SEPTON HG-252. Such blends are described in more detail in commonly-assigned U.S. Pat. No. 6,861,474 and U.S. Patent Publication No. 2003/0224871 both of which are incorporated herein by reference in their entireties.

Another preferred material for either the outer cover and/or one or intermediate layers of the golf balls of the present invention is a composition prepared by blending together at least three materials, identified as Components A, B, and C, and melt-processing these components to form in-situ, a polymer blend composition incorporating a pseudo-crosslinked polymer network. Such blends are described in more detail in commonly-assigned U.S. Pat. No. 6,930,150, to Kim et al, the content of which is incorporated by reference herein in its entirety. Component A is a monomer, oligomer, prepolymer or polymer that incorporates at least five percent by weight of at least one type of an acidic functional group. Examples of such polymers suitable for use as include, but are not limited to, ethylene/(meth)acrylic acid copolymers and ethylene/(meth)acrylic acid/alkyl (meth)acrylate terpolymers, or ethylene and/or propylene maleic anhydride copolymers and terpolymers. Examples of such polymers which are commercially available include, but are not limited to, the ESCOR® 5000, 5001, 5020, 5050, 5070, 5100, 5110 and 5200 series of ethylene-acrylic acid copolymers sold by Exxon and the PRIMACOR® 1321, 1410, 1410-XT, 1420, 1430, 2912, 3150, 3330, 3340, 3440, 3460, 4311, 4608 and 5980 series of ethylene-acrylic acid copolymers sold by The Dow Chemical Company, Midland, Mich. and the ethylene-acrylic acid copolymers Nucrel 599, 699, 0903, 0910, 925, 960, 2806, and 2906 ethylene-methacrylic acid copolymers. sold by DuPont Also included are the bimodal ethylene/carboxylic acid polymers as described in U.S. Pat. No. 6,562,906, the contents of which are incorporated herein by reference. These polymers comprise ethylene/α, β-ethylenically unsaturated $C_{3-8}$ carboxylic acid high copolymers, particularly ethylene (meth) acrylic acid copolymers and ethylene, alkyl (meth)acrylate, (meth)acrylic acid terpolymers, having molecular weights of about 80,000 to about 500,000 which are melt blended with ethylene/α, β-ethylenically unsaturated $C_{3-8}$ carboxylic acid copolymers, particularly ethylene/(meth)acrylic acid copolymers having molecular weights of about 2,000 to about 30,000.

Component B can be any monomer, oligomer, or polymer, preferably having a lower weight percentage of anionic functional groups than that present in Component A in the weight ranges discussed above, and most preferably free of such functional groups. Examples of materials for use as Component B include block copolymers such as styrenic block copolymers including styrene-butadiene-styrene (SBS), styrene-ethylene-butylene-styrene, (SEBS) and styrene-ethylene/propylene-styrene (SETS). Also included are functionalized styrenic block copolymers, including those where the block copolymer incorporates a first polymer block having an aromatic vinyl compound, a second polymer block having a conjugated diene compound and a hydroxyl group located at a block copolymer, or its hydrogenation product. Commercial examples include polyester elastomers marketed under the name PEBAX and LOTADER marketed by ATOFINA Chemicals of Philadelphia, Pa.; HYTREL, FUSABOND, and NUCREL marketed by E.I. DuPont de Nemours & Co. of Wilmington, Del.; SKYPEL and SKYTHANE by S.K. Chemicals of Seoul, South Korea; SEPTON (including SEPTON HG-252) and HYBRAR marketed by Kuraray Company of Kurashiki, Japan; ESTHANE by Noveon; and KRATON marketed by Kraton Polymers. SEPTON HG-252.

Component C is a base capable of neutralizing the acidic functional group of Component A and is a base having a metal cation. These metals are from groups IA, IB, IIA, JIB, IIIA, IIIB, IVA, IVB, VA, VB, VIA, VIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal oxides, metal carbonates, or metal acetates. In addition to Components A, B, and C, other materials commonly used in polymer blend compositions, can be incorporated into compositions prepared using the method of the present invention, including: crosslinking agents, co-crosslinking agents, accelerators, activators, UV-active chemicals such as UV initiators, EB-active chemicals, colorants, UV stabilizers, optical brighteners, antioxidants, processing aids, mold release agents, foaming agents, and organic, inorganic or metallic fillers or fibers, including fillers to adjust specific gravity.

The composition preferably is prepared by mixing the above materials into each other thoroughly, either by using a dispersive mixing mechanism, a distributive mixing mechanism, or a combination of these. These mixing methods are well known in the manufacture of polymer blends. As a result of this mixing, the anionic functional group of Component A is dispersed evenly throughout the mixture. Most preferably, Components A and B are melt-mixed together without Component C, with or without the premixing discussed above, to produce a melt-mixture of the two components. Then, Component C separately is mixed into the blend of Components A and B. This mixture is melt-mixed to produce the reaction product. This two-step mixing can be performed in a single process, such as, for example, an extrusion process using a proper barrel length or screw configuration, along with a multiple feeding system.

Another preferred material which may be used as a component of the cover layer or intermediate layer of the golf balls of the present invention are the polyalkenamers which may be prepared by ring opening metathesis polymerization of one or more cycloalkenes in the presence of organometallic catalysts as described in U.S. Pat. Nos. 3,492,245, and 3,804,803, the entire contents of both of which are herein incorporated by reference. Examples of suitable polyalkenamer rubbers are polypentenamer rubber, polyheptenamer rubber, polyoctenamer rubber, polydecenamer rubber and polydodecenamer rubber. For further details concerning polyalkenamer rubber, see Rubber Chem. & Tech., Vol. 47, page 511-596, 1974, which is incorporated herein by reference. Polyoctenamer rubbers are commercially available from Huls AG of Marl, Germany, and through its distributor in the U.S., Creanova Inc. of Somerset, N.J., and sold under the trademark VESTENAMER®. Two grades of the VESTENAMER® trans-polyoctenamer are commercially available: VESTENAMER 8012 designates a material having a trans-content of approximately 80% (and a cis-content of 20%) with a melting point of approximately 54° C.; and VESTENAMER 6213 designates a material having a trans-content of approximately 60% (cis-content of 40%) with a melting point of approximately 30° C. Both of these polymers have a double bond at every eighth carbon atom in the ring.

The polyalkenamer rubbers used in the present invention exhibit excellent melt processability above their sharp melting temperatures and exhibit high miscibility with various rubber additives as a major component without deterioration of crystallinity which in turn facilitates injection molding. Thus, unlike synthetic rubbers typically used in golf ball preparation, polyalkenamer-based compounds can be prepared which, are injection moldable. This is disclosed in copending U.S. application Ser. No. 11/335,070, filed on Jan. 18, 2006, in the name of Hyun Kim et al., the entire contents of which are hereby incorporated by reference.

The cores of the golf balls of the present invention may include the traditional rubber components used in golf ball applications including, both natural and synthetic rubbers, such as cis-1,4-polybutadiene, trans-1,4-polybutadiene, 1,2-polybutadiene, cis-polyisoprene, trans-polyisoprene, polychloroprene, polybutylene, styrene-butadiene rubber, styrene-butadiene-styrene block copolymer and partially and fully hydrogenated equivalents, styrene-isoprene-styrene block copolymer and partially and fully hydrogenated equivalents, nitrile rubber, silicone rubber, and polyurethane, as well as mixtures of these. Polybutadiene rubbers, especially 1,4-polybutadiene rubbers containing at least 40 mol %, and more preferably 80 to 100 mol % of cis-1,4 bonds, are preferred because of their high rebound resilience, moldability, and high strength after vulcanization. The polybutadiene component may be synthesized by using rare earth-based catalysts, nickel-based catalysts, or cobalt-based catalysts, conventionally used in this field. Polybutadiene obtained by using lanthanum rare earth-based catalysts usually employ a combination of a lanthanum rare earth (atomic number of 57 to 71)-compound, but particularly preferred is a neodymium compound.

The 1,4-polybutadiene rubbers have a molecular weight distribution (Mw/Mn) of from about 1.2 to about 4.0, preferably from about 1.7 to about 3.7, even more preferably from about 2.0 to about 3.5, most preferably from about 2.2 to about 3.2. The polybutadiene rubbers have a Mooney viscosity ($ML_{1+4}$ (100° C.)) of from about 20 to about 80, preferably from about 30 to about 70, even more preferably from about 30 to about 60, most preferably from about 35 to about 50. The term "Mooney viscosity" used herein refers in each case to an industrial index of viscosity as measured with a Mooney viscometer, which is a type of rotary plastometer (see JIS K6300). This value is represented by the symbol $ML_{1+4}$ (100° C.), wherein "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C. As readily appreciated by one skilled in the art, blends of polybutadiene rubbers may also be utilized in the golf balls of the present invention, such blends may be prepared with any mixture of rare earth-based catalysts, nickel-based catalysts, or cobalt-based catalysts derived materials, and from materials having different molecular weights, molecular weight distributions and Mooney viscosity.

The cores of the golf balls of the present invention may also include 1,2-polybutadienes having differing tacticity, all of which are suitable as unsaturated polymers for use in the presently disclosed compositions, are atactic 1,2-polybutadiene, isotactic 1,2-polybutadiene, and syndiotactic 1,2-polybutadiene. Syndiotactic 1,2-polybutadiene having crystallinity suitable for use as an unsaturated polymer in the presently disclosed compositions are polymerized from a 1,2-addition of butadiene. The presently disclosed golf balls may include syndiotactic 1,2-polybutadiene having crystallinity and greater than about 70% of 1,2-bonds, more preferably greater than about 80% of 1,2-bonds, and most preferably greater than about 90% of 1,2-bonds. Also, the 1,2-polybutadiene may have a mean molecular weight between about 10,000 and about 350,000, more preferably between about 50,000 and about 300,000, more preferably between about 80,000 and about 200,000, and most preferably between about 10,000 and about 150,000. Examples of suitable syndiotactic 1,2-polybutadienes having crystallinity suitable for use in golf balls are sold under the trade names RB810, RB820, and RB830 by JSR Corporation of Tokyo, Japan. These have more than 90% of 1,2 bonds, a mean molecular weight of approximately 120,000, and crystallinity between about 15% and about 30%.

The cores of the golf balls of the present invention may also include polyalkenamers. The polyalkenamers may be prepared by ring opening metathesis polymerization of one or more cycloalkenes in the presence of organometallic catalysts as described in U.S. Pat. Nos. 3,492,245, and 3,804,803, the entire contents of both of which are herein incorporated by reference. Examples of suitable polyalkenamer rubbers are polypentenamer rubber, polyheptenamer rubber, polyoctenamer rubber, polydecenamer rubber and polydodecenamer rubber. For further details concerning polyalkenamer rubber, see Rubber Chem. & Tech., Vol. 47, page 511-596, 1974, which is incorporated herein by reference. Polyoctenamer rubbers are commercially available from Huls AG of Marl, Germany, and through its distributor in the U.S., Creanova Inc. of Somerset, N.J., and sold under the trademark VESTENAMER®. Two grades of the VESTENAMER® trans-polyoctenamer are commercially available: VESTENAMER 8012 designates a material having a trans-content of approximately 80% (and a cis-content of 20%) with a melting point of approximately 54° C.; and VESTENAMER 6213 designates a material having a trans-content of approximately 60% (cis-content of 40%) with a melting point of approximately 30° C. Both of these polymers have a double bond at every eighth carbon atom in the ring.

The polyalkenamer rubbers used in the present invention exhibit excellent melt processability above their sharp melting temperatures and exhibit high miscibility with various rubber additives as a major component without deterioration of crystallinity which in turn facilitates injection molding. Thus, unlike synthetic rubbers typically used in golf ball preparation, polyalkenamer-based compounds can be prepared which, are injection moldable. This is disclosed in copending U.S. application Ser. No. 11/335,070, filed on Jan. 18, 2006, in the name of Hyun Kim et al., the entire contents of which are hereby incorporated by reference.

When synthetic rubbers such as the aforementioned polybutadienes or polyalkenamers and their blends are used in the golf balls of the present invention they may contain further materials typically often used in rubber formulations including crosslinking agents, co-crosslinking agents, peptizers and accelerators.

Suitable cross-linking agents for use in the golf balls of the present invention include peroxides, sulfur compounds, or other known chemical cross-linking agents, as well as mixtures of these. Non-limiting examples of suitable cross-linking agents include primary, secondary, or tertiary aliphatic or aromatic organic peroxides. Peroxides containing more than one peroxy group can be used, such as 2,5-dimethyl-2,5-di (tert-butylperoxy)hexane and 1,4-di-(2-tert-butyl peroxyisopropyl)benzene. Both symmetrical and asymmetrical peroxides can be used, for example, tert-butyl per benzoate and tert-butyl cumuli peroxide. Peroxides incorporating carboxyl groups also are suitable. The decomposition of peroxides used as cross-linking agents in the present invention can be brought about by applying thermal energy, shear, irradiation, reaction with other chemicals, or any combination of these. Both homiletically and hydrolytically decomposed peroxide can be used in the present invention. Non-limiting examples of suitable peroxides include: dactyl peroxide; did-tert-butyl peroxide; dibenzoyl peroxide; dicumyl peroxide; 2,5-dimethyl-2,5-di(benzoylperoxy)hexane; 1,4-bis-(t-butylperoxyisopropyl)benzene; t-butylperoxybenzoate; 2,5-dimethyl-2,5-di-(t-butylperoxy)hexyne-3, such as Trigonox 145-45B, marketed by Akrochem Corp. of Akron, Ohio; 1,1-bis(t-butylperoxy)-3,3,5 tri-methylcyclohexane, such as Varox 231-XL, marketed by R.T. Vanderbilt Co., Inc. of Norwalk, Conn.; and did-(2,4-dichlorobenzoyl)peroxide. The cross-linking agents can be blended in total amounts of about 0.05 part to about 5 parts, more preferably about 0.2 part to about 3 parts, and most preferably about 0.2 part to about 2 parts, by weight of the cross-linking agents per 100 parts by weight of the unsaturated polymer.

Each cross-linking agent has a characteristic decomposition temperature at which 50% of the cross-linking agent has decomposed when subjected to that temperature for a specified time period ($t_{1/2}$). For example, 1,1-bis-(t-butylperoxy)-3,3,5-tri-methylcyclohexane at $t_{1/2}$=0.1 hr has a decomposition temperature of 138° C. and 2,5-dimethyl-2,5-di-(t-butylperoxy)hexyne-3 at $t_{1/2}$=0.1 hr has a decomposition temperature of 182° C. Two or more cross-linking agents having different characteristic decomposition temperatures at the same $t_{1/2}$ may be blended in the composition. For example, where at least one cross-linking agent has a first characteristic decomposition temperature less than 150° C., and at least one cross-linking agent has a second characteristic decomposition temperature greater than 150° C., the composition weight ratio of the at least one cross-linking agent having the first characteristic decomposition temperature to the at least one cross-linking agent having the second characteristic decomposition temperature can range from 5:95 to 95:5, or more preferably from 10:90 to 50:50.

Besides the use of chemical cross-linking agents, exposure of the composition to radiation also can serve as a cross-linking agent. Radiation can be applied to the unsaturated polymer mixture by any known method, including using microwave or gamma radiation, or an electron beam device. Additives may also be used to improve radiation curing of the diene polymer.

The rubber and cross-linking agent may be blended with a co-cross-linking agent, which may be a metal salt of an unsaturated carboxylic acid. Examples of these include zinc and magnesium salts of unsaturated fatty acids having 3 to 8 carbon atoms, such as acrylic acid, methacrylic acid, maleic acid, and fumaric acid, palmitic acid with the zinc salts of acrylic and methacrylic acid being most preferred. The unsaturated carboxylic acid metal salt can be blended in a rubber either as a preformed metal salt, or by introducing an α,β-unsaturated carboxylic acid and a metal oxide or hydroxide into the rubber composition, and allowing them to react in the rubber composition to form a metal salt. The unsaturated carboxylic acid metal salt can be blended in any desired amount, but preferably in amounts of about 10 parts to about 60 parts by weight of the unsaturated carboxylic acid per 100 parts by weight of the synthetic rubber.

The core compositions used in the present invention may also incorporate one or more of the so-called "peptizers". The peptizer preferably comprises an organic sulfur compound and/or its metal or non-metal salt. Examples of such organic sulfur compounds include thiophenols, such as pentachlorothiophenol, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; did(pentachlorophenyl) disulfide; dibenzamido diphenyldisulfide (DBDD), and alkylated phenol sulfides, such as VULTAC marketed by Atofina Chemicals, Inc. of Philadelphia, Pa. Preferred organic sulfur compounds include pentachlorothiophenol, and dibenzamido diphenyldisulfide.

Examples of the metal salt of an organic sulfur compound include sodium, potassium, lithium, magnesium calcium, barium, cesium and zinc salts of the above-mentioned thiophenols and thiocarboxylic acids, with the zinc salt of pentachlorothiophenol being most preferred.

Examples of the non-metal salt of an organic sulfur compound include ammonium salts of the above-mentioned thiophenols and thiocarboxylic acids wherein the ammonium cation has the general formula $[NR^1R^2R^3R^4]^+$ where $R^1$, $R^2$, $R^3$ and $R^4$ are selected from the group consisting of hydrogen, a $C_1$-$C_{20}$ aliphatic, cycloaliphatic or aromatic moiety, and any and all combinations thereof, with the most preferred being the $NH_4^+$-salt of pentachlorothiophenol.

Additional peptizers include aromatic or conjugated peptizers comprising one or more heteroatoms, such as nitrogen, oxygen and/or sulfur. More typically, such peptizers are heteroaryl or heterocyclic compounds having at least one heteroatom, and potentially plural heteroatoms, where the plural heteroatoms may be the same or different. Such peptizers include peptizers such as an indole peptizer, a quinoline peptizer, an isoquinoline peptizer, a pyridine peptizer, purine peptizer, a pyrimidine peptizer, a diazine peptizer, a pyrazine peptizer, a triazine peptizer, a carbazole peptizer, or combinations of such peptizers.

Suitable peptizers also may include one or more additional functional groups, such as halogens, particularly chlorine; a sulfur-containing moiety exemplified by thiols, where the functional group is sulfhydryl (—SH), thioethers, where the functional group is —SR, disulfides, ($R_1S$—$SR_2$), etc.; and combinations of functional groups. Such peptizers are more fully disclosed in copending U.S. Application No. 60/752,475 filed on Dec. 20, 2005 in the name of Hyun Kim et al, the entire contents of which are herein incorporated by reference. A most preferred example is 2,3,5,6-tetrachloro-4-pyridinethiol (TCPT).

The peptizer, if employed in the golf balls of the present invention, is present in an amount up to about 10, from about 0.01 to about 10, preferably of from about 0.10 to about 7, more preferably of from about 0.15 to about 5 parts by weight per 100 parts by weight of the synthetic rubber component.

The core compositions can also comprise one or more accelerators of one or more classes. Accelerators are added to an unsaturated polymer to increase the vulcanization rate and/or decrease the vulcanization temperature. Accelerators can be of any class known for rubber processing including mercapto-, sulfenamide-, thiuram, dithiocarbamate, dithiocarbamyl-sulfenamide, xanthate, guanidine, amine, thiourea, and dithiophosphate accelerators. Specific commercial accelerators include 2-mercaptobenzothiazole and its metal or non-metal salts, such as Vulkacit Mercapto C, Mercapto MGC, Mercapto ZM-5, and ZM marketed by Bayer AG of Leverkusen, Germany, Nocceler M, Nocceler MZ, and Nocceler M-60 marketed by Ouchisinko Chemical Industrial Company, Ltd. of Tokyo, Japan, and MBT and ZMBT marketed by Akrochem Corporation of Akron, Ohio. A more complete list of commercially available accelerators is given in The Vanderbilt Rubber Handbook: 13$^{th}$ Edition (1990, R.T. Vanderbilt Co.), pp. 296-330, in Encyclopedia of Polymer Science and Technology, Vol. 12 (1970, John Wiley & Sons), pp. 258-259, and in Rubber Technology Handbook (1980, Hanser/Gardner Publications), pp. 234-236. Preferred accelerators include 2-mercaptobenzothiazole (MBT) and its salts. The synthetic rubber composition can further incorporate from about 0.1 part to about 10 parts by weight of the accelerator per 100 parts by weight of the rubber. More preferably, the ball composition can further incorporate from about 0.2 part to about 5 parts, and most preferably from about 0.5 part to about 1.5 parts, by weight of the accelerator per 100 parts by weight of the rubber.

The polymeric compositions used to prepare the golf balls of the present invention also can incorporate one or more fillers. Such fillers are typically in a finely divided form, for example, in a size generally less than about 20 mesh, preferably less than about 100 mesh U.S. standard size, except for fibers and flock, which are generally elongated. Filler particle size will depend upon desired effect, cost, ease of addition, and dusting considerations. The appropriate amounts of filler required will vary depending on the application but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten, steel, copper, cobalt or iron, metal alloys, tungsten carbide, metal oxides, metal stearates, and other particulate carbonaceous materials, and any and all combinations thereof. Preferred examples of fillers include metal oxides, such as zinc oxide and magnesium oxide. In another preferred aspect the filler comprises a continuous or non-continuous fiber. In another preferred aspect the filler comprises one or more so called nanofillers, as described in U.S. Pat. No. 6,794,447 and copending U.S. patent application Ser. No. 10/670,090 filed on Sep. 24, 2003 and copending U.S. patent application Ser. No. 10/926,509 filed on Aug. 25, 2004, the entire contents of each of which are incorporated herein by reference.

Inorganic nanofiller material generally is made of clay, such as hydrotalcite, phyllosilicate, saponite, hectorite, beidellite, stevensite, vermiculite, halloysite, mica, montmorillonite, micafluoride, or octosilicate. To facilitate incorporation of the nanofiller material into a polymer material, either in preparing nanocomposite materials or in preparing polymer-based golf ball compositions, the clay particles generally are coated or treated by a suitable compatibilizing agent. The compatibilizing agent allows for superior linkage between the inorganic and organic material, and it also can account for the hydrophilic nature of the inorganic nanofiller material and the possibly hydrophobic nature of the polymer. Compatibilizing agents may exhibit a variety of different structures depending upon the nature of both the inorganic nanofiller material and the target matrix polymer. Non-limiting examples include hydroxy-, thiol-, amino-, epoxy-, carboxylic acid-, ester-, amide-, and siloxy-group containing compounds, oligomers or polymers. The nanofiller materials can be incorporated into the polymer either by dispersion into the particular monomer or oligomer prior to polymerization, or by melt compounding of the particles into the matrix polymer. Examples of commercial nanofillers are various Cloisite grades including 10A, 15A, 20A, 25A, 30B, and NA+ of Southern Clay Products (Gonzales, Tex.) and the Nanomer grades including 1.24TL and C.30EVA of Nanocor, Inc. (Arlington Heights, Ill.).

Nanofillers when added into a matrix polymer, such as the polyalkenamer rubber, can be mixed in three ways. In one type of mixing there is dispersion of the aggregate structures within the matrix polymer, but on mixing no interaction of the matrix polymer with the aggregate platelet structure occurs, and thus the stacked platelet structure is essentially maintained. As used herein, this type of mixing is defined as "undispersed".

However, if the nanofiller material is selected correctly, the matrix polymer chains can penetrate into the aggregates and separate the platelets, and thus when viewed by transmission electron microscopy or x-ray diffraction, the aggregates of platelets are expanded. At this point the nanofiller is said to be substantially evenly dispersed within and reacted into the structure of the matrix polymer. This level of expansion can occur to differing degrees. If small amounts of the matrix polymer are layered between the individual platelets then, as used herein, this type of mixing is known as "intercalation".

In some circumstances, further penetration of the matrix polymer chains into the aggregate structure separates the platelets, and leads to a complete disruption of the platelet's stacked structure in the aggregate. Thus, when viewed by transmission electron microscopy (TEM), the individual platelets are thoroughly mixed throughout the matrix polymer. As used herein, this type of mixing is known as "exfoliated". An exfoliated nanofiller has the platelets fully dispersed throughout the polymer matrix; the platelets may be dispersed unevenly but preferably are dispersed evenly.

While not wishing to be limited to any theory, one possible explanation of the differing degrees of dispersion of such nanofillers within the matrix polymer structure is the effect of the compatibilizer surface coating on the interaction between the nanofiller platelet structure and the matrix polymer. By careful selection of the nanofiller it is possible to vary the penetration of the matrix polymer into the platelet structure of the nanofiller on mixing. Thus, the degree of interaction and intrusion of the polymer matrix into the nanofiller controls the separation and dispersion of the individual platelets of the nanofiller within the polymer matrix. This interaction of the polymer matrix and the platelet structure of the nanofiller is defined herein as the nanofiller "reacting into the structure of the polymer" and the subsequent dispersion of the platelets within the polymer matrix is defined herein as the nanofiller "being substantially evenly dispersed" within the structure of the polymer matrix.

If no compatibilizer is present on the surface of a filler such as a clay, or if the coating of the clay is attempted after its addition to the polymer matrix, then the penetration of the matrix polymer into the nanofiller is much less efficient, very little separation and no dispersion of the individual clay platelets occurs within the matrix polymer.

Physical properties of the polymer will change with the addition of nanofiller. The physical properties of the polymer are expected to improve even more as the nanofiller is dispersed into the polymer matrix to form a nanocomposite.

Materials incorporating nanofiller materials can provide these property improvements at much lower densities than those incorporating conventional fillers. For example, a nylon-6 nanocomposite material manufactured by RTP Corporation of Wichita, Kans., uses a 3% to 5% clay loading and has a tensile strength of 11,800 psi and a specific gravity of 1.14, while a conventional 30% mineral-filled material has a tensile strength of 8,000 psi and a specific gravity of 1.36. Using nanocomposite materials with lower inorganic materials loadings than conventional fillers provides the same properties, and this allows products comprising nanocomposite fillers to be lighter than those with conventional fillers, while maintaining those same properties.

Nanocomposite materials are materials incorporating up to about 20%, or from about 0.1% to about 20%, preferably from about 0.1% to about 15%, and most preferably from about 0.1% to about 10% of nanofiller reacted into and substantially dispersed through intercalation or exfoliation into the structure of an organic material, such as a polymer, to provide strength, temperature resistance, and other property improvements to the resulting composite. Descriptions of particular nanocomposite materials and their manufacture can be found in U.S. Pat. Nos. 5,962,553 to Ellsworth, 5,385,776 to Maxfield et al., and 4,894,411 to Okada et al. Examples of nanocomposite materials currently marketed include M1030D, manufactured by Unitika Limited, of Osaka, Japan, and 1015C2, manufactured by UBE America of New York, N.Y.

When nanocomposites are blended with other polymer systems, the nanocomposite may be considered a type of nanofiller concentrate. However, a nanofiller concentrate may be more generally a polymer into which nanofiller is mixed; a nanofiller concentrate does not require that the nanofiller has reacted and/or dispersed evenly into the carrier polymer.

For the polyalkenamers, the nanofiller material is added in an amount up to about 20 wt %, from about 0.1% to about 20%, preferably from about 0.1% to about 15%, and most preferably from about 0.1% to about 10% by weight (based on the final weight of the polymer matrix material) of nanofiller reacted into and substantially dispersed through intercalation or exfoliation into the structure of the core polymer matrix.

If desired, the various polymer compositions used to prepare the golf balls of the present invention can additionally contain other conventional additives such as plasticizers, pigments, antioxidants, U.V. absorbers, optical brighteners, or any other additives generally employed in plastics formulation or the preparation of golf balls.

Another particularly well-suited additive for use in the compositions of the present invention includes compounds having the general formula:

$$(R_2N)_m—R'—(X(O)_nOR_y)_m,$$

where R is hydrogen, or a $C_1$-$C_{20}$ aliphatic, cycloaliphatic or aromatic systems; R' is a bridging group comprising one or more $C_1$-$C_{20}$ straight chain or branched aliphatic or alicyclic groups, or substituted straight chain or branched aliphatic or alicyclic groups, or aromatic group, or an oligomer of up to 12 repeating units including, but not limited to, polypeptides derived from an amino acid sequence of up to 12 amino acids; and X is C or S or P with the proviso that when X=C, n=1 and y=1 and when X=S, n=2 and y=1, and when X=P, n=2 and y=2. Also, m=1-3. These materials are more fully described in copending U.S. patent application Ser. No. 11/182,170, filed on Jul. 14, 2005, the entire contents of which are incorporated herein by reference. These materials include, without limitation, caprolactam, oenantholactam, decanolactam, undecanolactam, dodecanolactam, caproic 6-amino acid, 11-aminoundecanoicacid, 12-aminododecanoic acid, diamine hexamethylene salts of adipic acid, azeleic acid, sebacic acid and 1,12-dodecanoic acid and the diamine nonamethylene salt of adipic acid., 2-aminocinnamic acid, L-aspartic acid, 5-aminosalicylic acid, aminobutyric acid; aminocaproic acid; aminocapyryic acid; 1-(aminocarbonyl)-1-cyclopropanecarboxylic acid; aminocephalosporanic acid; aminobenzoic acid; aminochlorobenzoic acid; 2-(3-amino-4-chlorobenzoyl)benzoic acid; aminonaphtoic acid; aminonicotinic acid; aminonorbornanecarboxylic acid; aminoorotic acid; aminopenicillanic acid; aminopentenoic acid; (aminophenyl)butyric acid; aminophenyl propionic acid; aminophthalic acid; aminofolic acid; aminopyrazine carboxylic acid; aminopyrazole carboxylic acid; aminosalicylic acid; aminoterephthalic acid; aminovaleric acid; ammonium hydrogencitrate; anthranillic acid; aminobenzophenone carboxylic acid; aminosuccinamic acid, epsilon-caprolactam; omega-caprolactam, (carbamoylphenoxy)acetic acid, sodium salt; carbobenzyloxy aspartic acid; carbobenzyl glutamine; carbobenzyloxyglycine; 2-aminoethyl hydrogensulfate; aminonaphthalenesulfonic acid; aminotoluene sulfonic acid; 4,4'-methylene-bis-(cyclohexylamine)carbamate and ammonium carbamate.

Most preferably the material is selected from the group consisting of 4,4'-methylene-bis-(cyclohexylamine)carbamate (commercially available from R.T. Vanderbilt Co., Norwalk Conn. under the tradename Diak® 4), 11-aminoundecanoicacid, 12-aminododecanoic acid, epsilon-caprolactam; omega-caprolactam, and any and all combinations thereof.

In an especially preferred aspect, a nanofiller additive component in the golf ball of the present invention is surface modified with a compatibilizing agent comprising the earlier described compounds having the general formula:

$$(R_2N)_m—R'—(X(O)_nOR_y)_m,$$

A most preferred aspect would be a filler comprising a nanofiller clay material surface modified with an amino acid including 12-aminododecanoic acid. Such fillers are available from Nanonocor Co. under the tradename Nanomer 1.24TL.

The filler can be blended in variable effective amounts, such as amounts of greater than 0 to at least about 80 parts, and more typically from about 10 parts to about 80 parts, by weight per 100 parts by weight of the base rubber. If desired, the rubber composition can additionally contain effective amounts of a plasticizer, an antioxidant, and any other additives generally used to make golf balls.

Various compositions used as a component of the golf balls of the present invention may also comprise a monomeric amide modifier or modifiers, such as a monomeric aliphatic and/or aromatic amide polymer modifier or modifiers. An amide is any organic compound containing the group —$CONR_2$, where R is hydrogen; an aliphatic group, such as an alkyl group, an alkenyl group, or an alkynyl group; an aromatic group; and combinations thereof. Amides useful for the present invention may be a primary amide, a secondary amide, or a tertiary amide, and combinations thereof, i.e. a particular compound may have two or more amide moieties where one of the amide moieties is a primary, secondary or tertiary amide and the other amide moiety has a degree of substitution different from the first amide moiety. For example, if the first amide is a primary amide, the second amide moiety may be secondary or tertiary.

The amide may be saturated or unsaturated. Moreover, unsaturated amides may have more than one site of unsaturation, including aromatic amides. Alkene amides may have a cis double bond or a trans double bond. For compounds having plural sites of unsaturation, such double bonds can be all cis, all trans, or any combination of cis and trans double bonds. Certain compounds perform better as polymer modifier if the olefin is entirely or predominantly cis, or entirely or predominantly trans. Moreover, the position of the double bond in the compound may affect the compound's usefulness for modifying polymer compositions.

Amidated aliphatic and/or aromatic compounds useful for the present invention typically have from about 1 to about 100 carbon atoms, more typically from about 2 to about 80 carbon atoms, even more typically from about 5 to about 50 carbon atoms, even more typically from about 5 to about 30 carbon atoms, and most typically from about 10 to about 25 carbon atoms.

Fatty acid amides are a particularly useful genus of amides for use with the present invention. Fatty acids are any of a class of aliphatic monocarboxylic acids that form part of a lipid molecule and can be derived from fat by hydrolysis; fatty acids are simple molecules built around a series of carbon atoms linked together in a chain, typically a chain having from about 12 to 22 carbon atoms.

Particular examples of amides for use with the present invention include, without limitation, primary amides, such as stearamide, behenamide, oleamide, and erucamide; secondary amides, such as stearyl erucamide, erucyl erucamide, oleyl palimitamide, stearyl stearamide, erucyl stearamide, and the like; ethylene bis-amides, such as N,N' ethylenebisstearamide, N,N' ethylenebisolamide, and the like; amidated natural waxes, such as carnauba wax amide, rice wax amide, montan wax amide, and the like; and combinations of any two or more of any suitable amide.

Suitable amide polymer composition modifiers can include a functional group or groups other than the amide functionality. For example and without limitation, amide polymer modifiers also can include additional functional groups such as hydroxyl, sulfhydryl, halides, glycidyl, carbonyl, carboxyl, anhydryl, ether, epoxide, amine, etc., and combinations of all such functional groups.

The polymer compositions of the present invention include amounts of the amide modifying agent effective to modify the compositions as desired. For example, amide modifiers can be used to provide more desirable rheological properties relative to non-modified polymeric compositions, more desirable mechanical properties relative to non-modified polymeric compositions, and combinations of rheological and mechanical properties. By way of example, it was surprising to find that useful polymeric compositions modified with a suitable monomeric amide, or amides, could be made such that the rheological properties, for example the melt flow index (MFI), could be advantageously modified. At the same time, mechanical properties, such as hardness, flexural modulus and COR, could be substantially maintained, and for some formulations improved, relative to the same composition without the monomeric amide, or amides. It was particularly surprising that useful amounts of modifying agents could be increased to relatively high concentrations, such as 1% by weight or greater, to modify certain polymer properties advantageously while maintaining suitable COR values.

By way of example and without limitation, it currently is believed that amide modifiers can be added in amounts ranging from about 0.1 to about 50 parts per hundred (pph), more typically from about 0.1 to about 20 pph, more typically from about 0.5 pph to about 15 pph, and most typically from about 1 to about 10 pph, based on the weight of the polymeric portion of the composition.

Golf balls within the scope of the present invention also can include, in suitable amounts, one or more additional ingredients generally employed in golf ball compositions. Agents provided to achieve specific functions, such as additives and stabilizers, can be present. Examplary suitable ingredients include colorants, antioxidants, colorants, dispersants, mold releasing agents, processing aids, fillers, and any and all combinations thereof. Although not required, UV stabilizers, or photo stabilizers such as substituted hydroxphenyl benzotriazoles may be utilized in the present invention to enhance the UV stability of the final compositions. An example of a commercially available UV stabilizer is the stabilizer sold by Ciba Geigy Corporation under the tradename TINUVIN.

The methods of making the polyamide/functional polymer modifier blends used in the present invention can incorporate a number of known processes. The various components can be mixed together using dry blending equipment, such as a tumbler mixer, V-blender, or ribbon blender, or by using a mill, internal mixer, extruder or combinations of these, with or without application of thermal energy to produce melting or chemical reaction. In methods within the scope of the present invention, the functional polymer modifier can be premixed with the polyamide to form a concentrate having a high concentration of functional polymer modifier. Then, this concentrate can be introduced into the base polyamide using dry blending or melt mixing. The functional polymer modifier also can be added to a color concentrate, which is then added to the composition to impart a white color to golf ball. Any combination of the above-mentioned mixing processes can be incorporated into methods within the scope of the present invention.

Also disclosed herein are methods for making golf ball covers and intermediate layers incorporating the above-described polyamide and functional polymer modifier blends.

The various formulations for the intermediate layer and/or cover layer may be produced using a twin-screw extruder or may be blended manually or mechanically prior to the addition to the injection molder feed hopper. Finished golf balls may be prepared by initially positioning the solid, preformed core in an injection-molding cavity, followed by uniform injection of the intermediate layer and/or cover layer composition sequentially over the core. The cover formulations can be injection molded around the cores to produce golf balls of the required diameter.

Alternatively, the cover layers may also be formed around the core by first forming half shells by injection molding followed by compression molding the half shells about the core to form the final ball.

Covers may also be formed around the cores using compression molding. Cover materials for compression molding may also be extruded or blended resins or castable resins such as polyurethane.

Typically the golf ball core is made by mixing together the unsaturated polymer, cross-linking agents, and other additives with or without melting them. Dry blending equipment, such as a tumbler mixer, V blender, ribbon blender, or two-roll mill, can be used to mix the compositions. The golf ball compositions can also be mixed using a mill, internal mixer such as a Banbury or Farrel continuous mixer, extruder or combinations of these, with or without application of thermal energy to produce melting. The various core components can be mixed together with the cross-linking agents, or each additive can be added in an appropriate sequence to the milled unsaturated polymer. In another method of manufacture the cross-linking agents and other components can be added to the unsaturated polymer as part of a concentrate using dry blending, roll milling, or melt mixing. If radiation is a cross-linking agent, then the mixture comprising the unsaturated polymer and other additives can be irradiated following mixing, during forming into a part such as the core of a ball, or after forming.

The resulting mixture can be subjected to, for example, a compression or injection molding process, to obtain solid spheres for the core. The polymer mixture is subjected to a molding cycle in which heat and pressure are applied while the mixture is confined within a mold. The cavity shape depends on the portion of the golf ball being formed. The compression and heat liberates free radicals by decomposing one or more peroxides, which initiate cross-linking. The temperature and duration of the molding cycle are selected based upon the type of peroxide and peptizer selected. The molding cycle may have a single step of molding the mixture at a single temperature for fixed time duration.

For example, a preferred mode of preparation for the cores used in the present invention is to first mix the core ingredients on a two-roll mill, to form slugs of approximately 30-40 g, and then compression-mold in a single step at a temperature between 150 to 180° C., for a time duration between 5 and 12 minutes.

The various core components may also be combined to form a golf ball by an injection molding process, which is also well known to one of ordinary skill in the art. The curing time depends on the various materials selected, and those of ordinary skill in the art will be readily able to adjust the curing time upward or downward based on the particular materials used and the discussion herein.

The polyamide/functional polymer modifier compositions disclosed herein comprise (A) from about 50 to about 95, preferably about 55 to about 90, more preferably from about 60 to about 85 wt % (based on the combined weight of Components A and B) of one or more homopolyamides or copolyamides; and B) from about 5 to about 50, preferably about 10 to about 45, more preferably from about 15 to about 40 wt % (based on the combined weight of Components A and B) of one or more functional polymer modifiers.

The polyamide/functional polymer modifier composition has a material Shore D hardness of from about 25 to about 85, preferably from about 30 to about 80, more preferably from about 35 to about 75.

The polyamide/functional polymer modifier composition has a flexural modulus from about 5 to about 500, preferably from about 15 to about 400, more preferably from about 20 to about 300, still more preferably from about 25 to about 200, and most preferably from about 30 to about 150 kpsi.

The polyamide/functional polymer modifier composition has a tensile elongation of at least about 20%, preferably at least about 40%, more preferably at least about 80%, and most preferably at least about 100%, at break.

The polyamide/functional polymer modifier composition has a tensile strength of at least 4000 psi, more particularly at least 4250 psi, and most particularly at least about 5000 psi.

Spheres of the polyamide/functional polymer compositions may be made for the purposes of evaluating their property performance. The polyamide/functional polymer modifier composition when formed into such spheres has a PGA compression of from about 30 to about 200, preferably from about 35 to about 185, more preferably from about 45 to about 180; and a COR greater than about 0.700, preferably greater than 0.710, more preferably greater than about 0.720, and most preferably greater than 0.730 at 125 ft/sec inbound velocity. In another aspect, the spheres can have a COR greater than about 0.780, preferably greater than 0.790, more preferably greater than about 0.795, and most preferably greater than 0.800 at 125 ft/sec inbound velocity.

The core of the balls may have a diameter of from about 0.5 to about 1.62, preferably from about 0.7 to about 1.60, more preferably from about 1 to about 1.58, yet more preferably from about 1.20 to about 1.54, and most preferably from about 1.40 to about 1.50 in.

The core of the balls also may have a PGA compression of from about 30 to about 200, preferably from about 35 to about 185, more preferably from about 45 to about 180, and most preferably from about 50 to about 120. In another aspect, the core of the balls may have a PGA compression of from about 30 to about 100, preferably from about 35 to about 90, more preferably from about 40 to about 80.

In one aspect the core may comprise the polyamide/functional polymer composition in the center and optionally, one or more core layers disposed around the center. These core layers may be made from the same polyamide/functional polymer composition as used in the center portion, or may be a different thermoplastic elastomer.

The various core layers (including the center) may each exhibit a different hardness. The difference between the center hardness and that of the next adjacent layer, as well as the difference in hardness between the various core layers may be greater than 2, preferably greater than 5, most preferably greater than 10 units of Shore D.

In one preferred aspect, the hardness of the center and each sequential layer increases progressively outwards from the center to outer core layer.

In another preferred aspect, the hardness of the center and each sequential layer decreases progressively inwards from the outer core layer to the center.

The golf ball may comprise from 0 to 5, preferably from 0 to 3, more preferably from 1 to 3, most preferably 1 to 2 intermediate layer(s).

In one preferred aspect, at least one of the intermediate layers comprises the novel blend compositions described herein.

In one preferred aspect, the golf ball is a three-piece ball with the polyamide/functional polymer modifier composition, used in the intermediate or mantle layer. In a more preferred aspect the three-piece ball has the polyamide/functional polymer modifier composition, used in the intermediate or mantle layer and a cover comprising a thermoplastic elastomer, a thermoplastic or thermoset polyurethane or an ionomer.

In another preferred aspect, the golf ball is a four-piece ball with the polyamide/functional polymer modifier composition, used in one of the two intermediate or mantle layers in the golf ball. In a more preferred aspect the four-piece ball has the polyamide/functional polymer modifier composition, used in the inner mantle or intermediate layer. In an especially preferred aspect, the four-piece ball has the polyamide/functional polymer modifier composition, used in the inner mantle or intermediate layer and a cover comprising a thermoplastic elastomer, a thermoplastic or thermoset polyurethane, or an ionomer.

In another preferred aspect, the golf ball is a four-piece ball with the polyamide/functional polymer modifier composition used in one of the two intermediate or mantle layers in the golf ball. In a more preferred aspect the four-piece ball has polyamide/functional polymer modifier composition, used in the outer mantle or outer intermediate layer. In an especially preferred aspect, the four-piece ball has the polyamide/functional polymer modifier composition used in the outer mantle or outer intermediate layer and a cover comprising a thermoplastic elastomer, a thermoplastic or thermoset polyurethane, or an ionomer.

In certain embodiments, the polyamide/functional polymer composition is the major ingredient in the core and/or intermediate layers meaning that the composition constitutes at least 50, particularly at least 60, more particularly at least 80, wt % of all the ingredients in the core and/or intermediate layer.

The one or more intermediate layers of the golf balls may have a thickness of about 0.01 to about 0.50 or about 0.01 to about 0.20, preferably from about 0.02 to about 0.30 or from about 0.02 to about 0.15, more preferably from about 0.03 to about 0.20 or from about 0.03 to about 0.10, and most preferably from about 0.03 to about 0.10 or about 0.03 to about 0.06 in.

The one or more intermediate layers of the golf balls also may have a hardness greater than about 25, preferably greater than about 30, more preferably greater than about 40, and most preferably greater than about 50, Shore D units.

The one or more intermediate layers of the golf balls may also have a flexural modulus from about 5 to about 500, preferably from about 15 to about 400, more preferably from about 20 to about 300, still more preferably from about 25 to about 200, and most preferably from about 30 to about 100 kpsi.

The cover layer of the balls may have a thickness of about 0.01 to about 0.10, preferably from about 0.02 to about 0.08, more preferably from about 0.03 to about 0.06 in.

The cover layer the balls may have a hardness Shore D from about 40 to about 70, preferably from about 45 to about 70 or about 50 to about 70, more preferably from 47 to about 68 or about 45 to about 70, and most preferably from about 50 to about 65.

The COR of the golf balls may be greater than about 0.760, preferably greater than about 0.780, more preferably greater than 0.790, most preferably greater than 0.795, and especially greater than 0.800 at 125 ft/sec inbound velocity. In another aspect, the COR of the golf balls may be greater than about 0.760, preferably greater than about 0.780, more preferably greater than 0.790, most preferably greater than 0.795, and especially greater than 0.800 at 143 ft/sec inbound velocity.

The golf balls disclosed herein may have a sound pressure level of from about 70 to about 95, preferably from about 75 to about 90, and most preferably from about 80 to about 85 decibels and a frequency of between about 2,000 to about 5,000, preferably from about 2,500 to about 4,500, and most preferably from about 3,000 to about 4,000 Hz. (In certain aspects, the "soft feel" of the golf ball may be measured by having a specific sound frequency and loudness which imparts a softer overall sound/feel to the golf ball. Frequency is a measure of the "pitch" of the sound, and true loudness is measured in decibel (db) levels. Balls can be hit or tested at 30 yard shots for sound and pitch and subsequently this translates into ball feel that the golfer experiences. By plotting db levels v. frequency, you obtain a ratio of "feel".)

EXAMPLES

Examples of the invention are given below by way of illustration and not by way of limitation.

The materials employed in the blend formulations were as follows:

Grilamid TR90 is a thermoplastic polyamide marketed by EMS Chemie.

Grivory GTR45 is a nylon marketed by EMS Chemie.

Lotader 7500 is a random terpolymer of Ethylene (E), Ethyl Acrylate (EA) and

Maleic Anhydride (MAH) commercially available from Arkema.

Exxelor VA 1801 and 1803 are ethylene copolymers functionalized with maleic anhydride and commercially available from ExxonMobil Chemical Surlyn® 8150 is a grade of ionomer commercially available from DuPont.

Surlyn® 9150 is a grade of ionomer commercially available from DuPont.

BR40 is a cis-1,4-polybutadiene rubber made with a rare earth catalyst and commercially available from Enichem.

ZnO is a rubber grade zinc oxide purchased from Akrochem (Akron, Ohio).

ZDA are zinc diacrylates purchased commercially from Sartomer.

The properties of Tensile Strength, Tensile Elongation, Flexural Modulus, PGA compression, C.O.R., Shore D hardness (measured on both the material and on the resulting ball) were conducted using the test methods as defined below.

Core or ball diameter was determined by using standard linear calipers or size gauge.

Core specific gravity was determined by electronic densimeter using ASTM D-792.

Compression is measured by applying a spring-loaded force to the golf ball center, golf ball core, or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

Thus, a Riehle compression of 100 would be the same as an Atti compression of 60.

Initial velocity of a golf ball after impact with a golf club is governed by the United States Golf Association ("USGA"). The USGA requires that a regulation golf ball can have an initial velocity of no more than 250 feet per second±2% or 255 feet per second. The USGA initial velocity limit is related to the ultimate distance that a ball may travel (280 yards±6%), and is also related to the coefficient of restitution ("COR"). The coefficient of restitution is the ratio of the relative velocity between two objects after direct impact to the relative velocity before impact. As a result, the COR can vary from 0 to 1, with 1 being equivalent to a perfectly or completely elastic collision and 0 being equivalent to a perfectly plastic or completely inelastic collision. Since a ball's COR directly influences the ball's initial velocity after club collision and travel distance, golf ball manufacturers are interested in this characteristic for designing and testing golf balls.

One conventional technique for measuring COR uses a golf ball or golf ball subassembly, air cannon, and a stationary steel plate. The steel plate provides an impact surface weighing about 100 pounds or about 45 kilograms. A pair of ballistic light screens, which measure ball velocity, are spaced apart and located between the air cannon and the steel plate. The ball is fired from the air cannon toward the steel plate over a range of test velocities from 50 ft/s to 180 ft/sec. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The coefficient of restitution can be calculated by the ratio of the outgoing transit time period to the incoming transit time period, $COR=T_{Out}/T_{in}$.

A "Mooney" viscosity is a unit used to measure the plasticity of raw or unvulcanized rubber. The plasticity in a Mooney unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

Shore D hardness was measured in accordance with ASTM Test D2240. Hardness of a layer on a ball or sphere was measured on the ball, perpendicular to a land area between the dimples.

Table 1 presents results of testing for tensile strength, tensile elongation using ASTM standards D-638, and flexural modulus, using ASTM standards D-790.

The ball performance may be determined using a Robot Driver Test, which utilized a commercial swing robot in conjunction with an optical system to measure ball speed, launch angle, and backspin after a golf ball is hit with a driver. In this test, a titanium driver is attached to a swing robot and the swing speed and power profile as well as tee location and club lie angle is setup to generate the following values using a Maxfli XS Tour golf ball as a reference:

Headspeed: 112 mph

Ballspeed: 160 mph

Launch Angle: 9 deg

Backspin: 3200 rpm

Then, the test ball is substituted for the reference ball and the corresponding values determined.

Golf ball Sound Pressure Level, S, in decibels (dB) and Frequency in hertz (Hz) was measured by dropping the ball from a height of 113 in onto a marble ("starnet crystal pink") stage of at least 12" square and 4.25 inches in thickness. The sound of the resulting impact was captured by a microphone positioned at a fixed proximity of 12 inches, and at an angle of 30 degrees from horizontal, from the impact position and resolved by software transformation into an intensity in db and a frequency in Hz.

Table 1 represents the physical properties of samples of inventive blends of the polyamide base resin Grilamid TR90 with impact modifiers such as Exxelor VA 1801, and also Lotader 7500. Comparative Example 1 is a blend of Surlyn 8150 and Surlyn 9150. The amounts shown are in parts by weight (pbw). The blends are molded into spheres for testing.

TABLE 1

Mechanical and Physical Properties of Polyamide Blends with Impact Modifiers.

| | Ex 1A | Ex 1B | Ex 1C | Ex 1D | Ex 1E | Comp Ex 1 |
|---|---|---|---|---|---|---|
| TR90 | 100 | 100 | 75 | 75 | 74 | |
| Exxelor VA1801 | 35 | 35 | | | | |
| Lotader 7500 | | | 25 | 25 | 26 | |
| Erucamide | | 1.5 | | 1.5 | | |
| Surlyn 8150 | | | | | | 50 |
| Surlyn 9150 | | | | | | 50 |
| Specimen Properties | | | | | | |
| Tensile Strength (psi) | 6476.1 | 5565.3 | 6068.1 | 4421 | 5598 | 3942 |
| Tensile Elongation (%) | 287.64 | 230.95 | 157.7 | 288.02 | 225 | 165 |
| Flexural Modulus (kpsi) | 120.31 | 122.64 | 144.55 | 139.33 | | |
| Sphere Properties | | | | | | |
| Shore D Hardness | 69.6 | 69.5 | 73.8 | 73.5 | 67 | 67 |
| Compression | 168 | 168 | 171 | 170 | 163 | 160 |
| COR | 0.72 | 0.724 | 0.748 | 0.738 | | |

The data in Table 1 shows that the polyamide blends used in the present invention exhibit significantly higher tensile strength than the comparative ionomers blend of similar hardness. The data also demonstrate that the addition of erucamide in the blend composition does not affect the physical and mechanical properties significantly, but improves the processability.

Table 2 summarizes data measured on mantled cores, the mantles of which were injection molded to a thickness of 0.05-inch over a 1.48-inch diameter-, 69 PGA compression-cis-polybutadiene rubber core. The mantle layers were made from compositions incorporating polyamides TR90 and GTR45 marketed by EMS Chemie. The impact modifiers such as Exxelor VA 1801 and Lotader 7500 were added into polyamide base resin.

TABLE 2

Physical properties measured on mantled cores.

| | Ex 2A | Ex 2B | Ex 2C | Ex 2D | Ex 2E | Ex 2F | Ex 2G |
|---|---|---|---|---|---|---|---|
| Polybutadiene Core | | | | | | | |
| Core size (in) | 1.48 | 1.48 | 1.48 | 1.48 | 1.48 | 1.48 | 1.48 |
| Compression | 69 | 69 | 69 | 69 | 69 | 69 | 69 |
| COR | 0.796 | 0.796 | 0.796 | 0.796 | 0.796 | 0.796 | 0.796 |

TABLE 2-continued

| Physical properties measured on mantled cores. | | | | | | | |
|---|---|---|---|---|---|---|---|
| | Ex 2A | Ex 2B | Ex 2C | Ex 2D | Ex 2E | Ex 2F | Ex 2G |
| Mantle blend | | | | | | | |
| TR90 | 100 | 100 | 100 | 100 | 75 | 75 | |
| GTR45 | | | | | | | 100 |
| Exxelor VA1801 | 10 | 20 | 35 | 35 | | | 20 |
| Lotader 7500 | | | | | 25 | 25 | |
| Erucamide | | | | 1.5 | | 1.5 | |
| Diameter (in) | 1.58 | 1.58 | 1.58 | 1.58 | 1.58 | 1.58 | 1.58 |
| Thickness (in) | 0.05 | 0.05 | 0.05 | 0.05 | 0.05 | 0.05 | 0.05 |
| Compression | 109 | 104 | 101 | 100 | 99 | 101 | 111 |
| Shore D hardness | 74.7 | 72.2 | 66.3 | 66 | 72.4 | 70.7 | 77.9 |
| COR | 0.819 | 0.811 | 0.804 | 0.804 | 0.804 | 0.806 | 0.822 |

The data in Table 2 shows that increasing the content of impact modifier in the polyamide decreases the hardness while still providing a high C.O.R.

A series of golf balls were then prepared by first preparing a core by compression molding a cis-polybutadiene blend to a final diameter of 1.48 in. Mantles were then injection molded over the rubber cores to give a mantled core diameter of 1.62 in. The mantle layers were made from compositions incorporating polyamide 74 wt % TR90 marketed by EMS Chemie and 26 wt % of the impact modifier Exxelor VA 1803 which was added into the polyamide base resin prior to injection molding the mantle. Alternatively, mantle layers were also prepared from a 50/50 wt % blend of two ionomer resins, Surlyn 8150 and Surlyn 91650 (commercially available from DuPont) and selected to give a similar on the ball hardness to the polyamide analogs. The balls were then finished by casting a thermoset urethane of 0.30 in thickness around the mantled cores. The test data on these balls is summarized in Table 3.

TABLE 3

| Golf Ball Properties | | | | | | |
|---|---|---|---|---|---|---|
| Preferred Specs | Ex 3A | Ex 3B | Ex 3C | Comp Ex 3A | Comp Ex 3B | Comp Ex 3C |
| Core physicals | | | | | | |
| Size | 1.51" | 1.51" | 1.51" | 1.51" | 1.51" | 1.51" |
| Compression | 50 | 60 | 70 | 50 | 62 | 71 |
| COR | 0.794 | 0.800 | 0.806 | 0.794 | 0.801 | 0.808 |
| Mantle materials | 74/26 TR90/Exxelor VA1803 | | | 50/50 Surlyn 8150/Surlyn 9150 | | |
| Size | | 1.62" | | | 1.62" | |
| Compression | 86 | 83 | 95 | 70 | 78 | 90 |
| Shore D Hardness | 67.9 | 67.1 | 66.6 | 66.2 | 67.1 | 66.7 |
| Cover Material | | | Thermoset Urethane | | | |
| Ball Physicals | | | | | | |
| Compression | 80 | 84 | 90 | 72 | 76 | 84 |
| Shore D Hardness | 59.2 | 60 | 59 | 59.3 | 60.4 | 59.3 |
| COR | 0.812 | 0.815 | 0.819 | 0.818 | 0.822 | 0.824 |
| 175 mph Driver Speed | | | | | | |
| Ball Speed | 173.3 | 175.1 | 175.4 | 173.7 | 175.1 | 175.9 |
| Driver Spin | 2663 | 2699 | 2676 | 2622 | 2707 | 2623 |

The balls of Examples 3A-C with the modified polyamide mantle although having improved tensile strength compared to ionomers-based mantles had a similar ball speed and spin in the 175 mph driver speed test as the analogous balls but having the ionomer blend mantle.

The sound properties of the balls of Examples 3A-C were also compared to those of two commercially available thermoset urethane covered balls but with ionomer-based mantles, the TaylorMade TP Red and TP Black as well as a commercially available ionomer-covered ball, the MAXFLI Distance Plus, the results of which are summarized in Table 4.

TABLE 4

| Golf Ball Sound Properties | | | | | | |
|---|---|---|---|---|---|---|
| Sound Properties | Ex 3a | Ex 3b | Ex 3c | MAXFLI Distance Plus | TaylorMadeTP Red 07 | TaylorMadeTP Black |
| SPL* (dB) | 81.4 | 81.8 | 82.3 | 88.5 | 82.6 | 84.8 |
| Frequency (Hz) | 3450 | 3500 | 3730 | 5680 | 3560 | 3910 |

• SPL: Sound Pressure Level

The golf balls of Examples 3a, b and c were found to have a soft feel corresponding to a sound pressure level of from about 80 to about 85 decibels and a frequency of between about 3000 to about 4000 Hz, values, which are both similar to urethane covered balls such as the TP Red and TP Black and much improved over ionomer-covered balls such as the MAXFLI Distance Plus, which exhibited both a higher sound pressure level and a much higher frequency.

The invention claimed is:

1. A golf ball comprising;

1) a unitary core, 2) an outer cover layer comprising a thermoset polyurethane or polyurea; and 3) three mantle layers, including an outer mantle layer immediately adjacent the outer cover layer, wherein the outer mantle layer comprises a blend composition of;

(A) from about 50 to about 95 wt % (based on the combined weight of Components A and B) of a polyamide; and (B) from about 5 to about 50 wt % (based on the combined weight of Components A and B) of one or more functional polymer modifiers selected from the group consisting of a copolymer having a glycidyl group, hydroxyl group, maleic anhydride group or carboxylic group, or a terpolymer having a glycidyl group, hydroxyl group, maleic anhydride group or carboxylic group, and mixtures thereof; and wherein said blend composition has a flexural modulus of from about 5 to about 500 kpsi, a Shore D hardness of from about 25 to about 85, and a tensile elongation of at least about 20% and wherein one of the mantle layers other than the outer mantle layer comprises a polyalkenamer, and one of the mantle layers other than the outer mantle layer comprises a modified ionomer.

2. The golf ball of claim 1 wherein in said blend composition;

A) Component A is present in an amount of from about 55 to about 90 wt % (based on the combined weight of Components A and B) and comprises one or more aliphatic or cycloaliphatic polyamides; and B) Component B is present in an amount of from about 10 to about 45 wt % (based on the combined weight of Components A and B) and comprises one or more maleic anhydride grafted polyolefins; and wherein said blend composition has a flexural modulus of from about 15 to about 400 kpsi, a Shore D hardness of from about 30 to about 80, and a tensile elongation of at least about 40%.

3. The golf ball of claim 1 wherein in said blend composition;

A) Component A is present in an amount of from about 60 to about 85 wt % (based on the combined weight of Components A and B) and comprises the cycloaliphatic polyamide, BMACM 12, formed by equimolar mixing of (bis(methyl-para-aminocyclohexyl) methane) obtained by virtually equimolar mixing of BMACM and of dodecanedioic acid; and B) Component B is present in an amount of from about 15 to about 40 wt % (based on the combined weight of Components A and B) and comprises one or more maleic anhydride grafted polyolefins selected from maleic anhydride-modified ethylene-propylene copolymer, maleic anhydride-modified ethylene-propylene-diene terpolymer, maleic anhydride-modified polyethylene, maleic anhydride-modified polypropylene, ethylene-ethylacrylate-maleic anhydride terpolymer, or maleic anhydride-indene-styrene-cumarone polymer;

wherein the blend composition has a flexural modulus of from about 200 to about 300 kpsi., a Shore D hardness of from about 35 to about 75, and a tensile elongation of at least about 80%.

4. The golf ball of claim 1 wherein said blend composition has a tensile strength of at least 4000 psi.

5. The golf ball of claim 3 wherein said blend composition has a tensile strength of at least 4000 psi.

6. The golf ball of claim 1 wherein said blend composition has a tensile strength of at least 4250 psi.

7. The golf ball of claim 1 wherein said blend composition has a tensile strength of at least 5000 psi.

8. The golf ball of claim 1 wherein Component A comprises a thermoplastic polyamide elastomer.

9. The golf ball of claim 1 wherein Component B comprises an αolefin.

10. The golf ball of claim 1 wherein the blend composition further comprises erucamide.

11. The golf ball of claim 1 wherein the blend composition comprises at least 60 wt % of all the ingredients of the outer mantle layer.

12. The golf ball of claim 3 wherein the blend composition comprises at least 60 wt % of all the ingredients of the outer mantle layer.

13. The golf ball of claim 1 wherein Component A comprises at least one cycloaliphatic polyamide and Component B comprises at least one maleic anhydride grafted polyolefin.

* * * * *